US008807475B2

(12) United States Patent
Rodrian et al.

(10) Patent No.: US 8,807,475 B2
(45) Date of Patent: Aug. 19, 2014

(54) DISPENSER WITH LOW-MATERIAL SENSING SYSTEM

(75) Inventors: James A. Rodrian, Grafton, WI (US); Sigurdur S. Witt, Ashwaubenon, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 885 days.

(21) Appl. No.: 12/619,486

(22) Filed: Nov. 16, 2009

(65) Prior Publication Data

US 2011/0114782 A1 May 19, 2011

(51) Int. Cl.
*B65H 63/08* (2006.01)

(52) U.S. Cl.
USPC ..... 242/563.2; 242/564.1; 242/565

(58) Field of Classification Search
USPC ..... 242/564, 564.1, 564.3, 563, 563.2, 565, 242/912
See application file for complete search history.

(56) References Cited

U.S. PATENT DOCUMENTS

| | | | |
|---|---|---|---|
| 4,450,398 | A | 5/1984 | Bose |
| 4,463,426 | A | 7/1984 | Caddick et al. |
| 4,738,176 | A | 4/1988 | Cassia |
| 4,796,825 | A | 1/1989 | Hawkins |
| 4,961,088 | A | 10/1990 | Gilliland et al. |
| 5,268,581 | A | 12/1993 | Showalter |
| 5,452,033 | A | 9/1995 | Balling et al. |
| 5,481,100 | A | 1/1996 | Terauchi |
| 5,497,326 | A | 3/1996 | Berland et al. |
| 5,507,277 | A | 4/1996 | Rubsamen et al. |
| 5,514,977 | A | 5/1996 | Agiman |
| 5,694,156 | A | 12/1997 | Hoisington et al. |
| 5,772,291 | A | 6/1998 | Byrd et al. |
| 5,829,434 | A | 11/1998 | Ambrosio et al. |
| 5,832,972 | A | 11/1998 | Thomas et al. |
| 5,940,103 | A | 8/1999 | Hetzer et al. |

(Continued)

FOREIGN PATENT DOCUMENTS

| | | | |
|---|---|---|---|
| CA | 2328540 | A1 | 6/2001 |
| FR | 2670927 | A1 | 12/1990 |

(Continued)

OTHER PUBLICATIONS

Notification of Transmittal of the International Search Report and Written Opinion. PCT Serial No. PCT/05/36582. 7 pages. Date: Feb. 24, 2006.

(Continued)

*Primary Examiner* — William A Rivera
(74) *Attorney, Agent, or Firm* — Jansson Munger McKinley & Shape Ltd.

(57) ABSTRACT

Apparatus, systems and methods for dispensing sheet material from a roll which include a low-material sensing system. The low-material sensing system provides an indication when the sheet material approaches depletion or is depleted so that the depleted sheet material roll can be replaced with a full roll. The low-material sensing system determines that the sheet material is depleted or near depletion by comparing the rotational speed of a sheet material roll from which the sheet material is unwound with the speed of the motor which produces movement of the sheet material roll when power is supplied to the motor. The sheet material roll speed increases as material is unwound while the motor speed remains relatively constant. A low-material indication is provided when the comparison reaches a threshold representative of the low-material state.

30 Claims, 17 Drawing Sheets

FIG. 1

(56) References Cited

U.S. PATENT DOCUMENTS

| | | | |
|---|---|---|---|
| 5,992,698 | A | 11/1999 | Copeland et al. |
| 5,995,774 | A | 11/1999 | Applegate et al. |
| 6,068,209 | A | 5/2000 | Nakamura |
| 6,069,354 | A | 5/2000 | Alfano et al. |
| 6,105,633 | A | 8/2000 | Pedersen et al. |
| 6,105,898 | A | 8/2000 | Byrd et al. |
| 6,109,480 | A | 8/2000 | Monsrud et al. |
| 6,143,257 | A | 11/2000 | Spriggs et al. |
| 6,158,486 | A | 12/2000 | Olson et al. |
| 6,170,937 | B1 | 1/2001 | Childers et al. |
| 6,209,184 | B1 | 4/2001 | Copeland et al. |
| 6,243,635 | B1 | 6/2001 | Swan et al. |
| 6,250,530 | B1 | 6/2001 | LaCount et al. |
| 6,262,546 | B1 | 7/2001 | Draves et al. |
| 6,293,486 | B1 | 9/2001 | Byrd et al. |
| 6,324,350 | B1 | 11/2001 | Ito et al. |
| 6,325,495 | B1 | 12/2001 | Foth |
| 6,363,228 | B1 | 3/2002 | Ream |
| 6,406,120 | B2 | 6/2002 | Pauschinger |
| 6,411,920 | B1 | 6/2002 | McConnell et al. |
| 6,419,136 | B2 | 7/2002 | Formon et al. |
| 6,446,901 | B1 | 9/2002 | Haen et al. |
| 6,460,798 | B1 | 10/2002 | Haen et al. |
| 6,517,025 | B1 | 2/2003 | Budz |
| 6,592,067 | B2 | 7/2003 | Denen et al. |
| 6,684,751 | B2 | 2/2004 | Kapiloff et al. |
| 6,695,246 | B1 | 2/2004 | Elliott et al. |
| 6,719,167 | B2 | 4/2004 | Chang |
| 6,830,210 | B2 | 12/2004 | Formon et al. |
| 6,854,684 | B2 | 2/2005 | Byrd et al. |
| 6,903,654 | B2 | 6/2005 | Hansen et al. |
| 6,977,588 | B2 | 12/2005 | Schotz et al. |
| 6,988,689 | B2 | 1/2006 | Thomas et al. |
| 7,040,566 | B1 | 5/2006 | Rodrian et al. |
| 7,044,421 | B1 | 5/2006 | Omdoll et al. |
| 7,084,592 | B2 | 8/2006 | Rodrian |
| 7,161,880 | B2 | 1/2007 | Okajima |
| 7,213,782 | B2 | 5/2007 | Osborne et al. |
| 7,231,317 | B2 | 6/2007 | Todd et al. |
| 7,296,765 | B2 | 11/2007 | Rodrian |
| 7,325,767 | B2 | 2/2008 | Elliott et al. |
| 7,325,768 | B2 | 2/2008 | Byrd et al. |
| 7,341,170 | B2 | 3/2008 | Boone |
| 7,354,015 | B2 | 4/2008 | Byrd et al. |
| 7,357,348 | B2 | 4/2008 | Kananen |
| 7,370,824 | B1 | 5/2008 | Osborne |
| 7,398,944 | B2 | 7/2008 | Lewis et al. |
| 7,434,760 | B2 | 10/2008 | Budz et al. |
| 7,507,045 | B1 | 3/2009 | Harris et al. |
| 7,546,973 | B2 | 6/2009 | Budz et al. |
| 7,549,814 | B1 | 6/2009 | Arrington et al. |
| 7,594,622 | B2 | 9/2009 | Witt et al. |
| 7,648,098 | B2 | 1/2010 | Goeking et al. |
| 7,674,054 | B2 | 3/2010 | Vorhees |
| 8,146,471 | B2 * | 4/2012 | Hansen et al. ..... 83/337 |
| 2003/0107341 | A1 * | 6/2003 | Morris ..... 318/599 |
| 2004/0133378 | A1 * | 7/2004 | Todd et al. ..... 702/115 |
| 2005/0077419 | A1 * | 4/2005 | Thomas et al. ..... 242/563 |
| 2007/0158359 | A1 | 7/2007 | Rodrian |
| 2010/0038987 | A1 * | 2/2010 | Kim ..... 310/179 |
| 2011/0148258 | A1 * | 6/2011 | Tanaka et al. ..... 310/68 B |

FOREIGN PATENT DOCUMENTS

| | | |
|---|---|---|
| JP | 62111861 | 5/1987 |
| JP | 5290227 | 11/1996 |
| JP | 2000136058 | 5/2000 |
| JP | 2002265115 | 9/2002 |
| JP | 200514250 | 1/2005 |
| JP | 2006256791 | 9/2006 |
| WO | WO2007068270 A1 | 6/2007 |

OTHER PUBLICATIONS

Notification of Transmittal of the International Search Report and Written Opinion. PCT Serial No. PCT/07/21176. 8 pages. Date: May 5, 2008.

Notification of Transmittal of the International Search Report and Written Opinion. PCT Serial No. PCT/09/006131. 14 pages. Date: Oct. 4, 2010.

* cited by examiner

DISPENSER WITH LOW-MATERIAL SENSING SYSTEM

FIELD

The field relates generally to dispenser control, and more particularly, to controlling a dispenser to indicate that a low-material state exists.

BACKGROUND

Automatic sheet material dispensers, such as paper towel dispensers and the like, are widely used to supply paper towel and other types of sheet material to persons in public restrooms, kitchens, food-preparation facilities and other settings in which hygiene and cleanliness are desired or in which sheet material is desired for some other purpose. The sheet material dispensed by these dispensers is typically in the form of a web wound into a roll on a core. The sheet material is unwound from the roll by the dispenser and is dispensed to the user.

A typical automatic paper towel dispenser is a battery-operated device with a direct current (DC) motor that is activated by a proximity sensor or contact switch. A controller controls the DC motor to dispense a predetermined amount of sheet material (e.g., 12 inches) for each activation of the proximity sensor or contact switch.

A problem with automatic sheet material dispensers, such as paper towel dispensers and the like, is that it can be difficult for the attendant to determine the amount of sheet material remaining on the roll and to determine whether a replacement roll should be loaded in the dispenser. It can be difficult to determine the amount of material remaining in the dispenser because the roll typically cannot be seen within the opaque dispenser housing. Therefore, the attendant must manually unlock and open the dispenser to view the roll and to determine whether a replacement roll should be loaded into the dispenser. This is time consuming and inconvenient for the attendant, particularly in facilities such as public restrooms which may include many dispensers. Obviously, it is important that the automatic sheet material dispenser have a supply of material because the dispenser cannot be used if there is no material available to be dispensed.

A paper towel dispenser with a low-paper indicator has been proposed as described in International Publication No. WO 2007/068270A1. The paper towel dispenser described in this document uses an angular displacement measurement system which may lack accuracy and requires parts which may increase the dispenser cost.

Automatic paper towel dispensers which detect loading of a proper roll of paper towel are known as described in U.S. Pat. No. 7,040,566 (Rodrian et al.). Also known are motor pulse counting techniques used to turn a paper towel dispenser motor "on" and "off" to dispense a length of paper as described in U.S. Pat. No. 7,084,592 (Rodrian). These technologies have not been utilized to control dispenser operation to indicate a low-material state.

Accordingly, what is needed are techniques to control automatic sheet material dispenser apparatus to indicate a low-material state which are efficient, cost effective, and which generally provide an improved dispenser.

SUMMARY

Low-material sensing apparatus, systems and methods are disclosed for indicating that sheet material dispensed from a sheet material roll is depleted or nearing depletion. The low-material sensing provides an indication that the depleted sheet material roll should be replaced with a full roll. This arrangement makes it possible to quickly and easily determine whether the sheet material roll requires replacement without having to open the apparatus to look at the sheet material roll. A highly-preferred application of the low-material sensing apparatus, systems and methods is in an automatic paper towel dispenser, although the low-material sensing may be implemented in other apparatus.

In an embodiment, the low-material sensing system includes a sensor, a motor, and a controller which controls the dispenser to provide an indication that a low-material state exists. Preferably, the indication is an indicator which is activated by the controller and alerts the attendant of the low-material state. The preferred controller provides a circuit which is preferably coupled to the sensor, motor and indicator and preferably includes a software-controlled microcontroller with an embedded analog-to-digital (A/D) converter.

According to a preferred embodiment, the sensor generates a sensor signal indicative of sheet material roll rotation. The motor has an armature and produces movement of the sheet material when current is supplied to the motor. The motor produces a motor signal indicative of at least one of motor current and motor voltage as the armature rotates. Preferably, the motor signal is produced when current supply to the motor is activated and when current supply to the motor is deactivated and the motor is coasting. The circuit supplies to the microcontroller processing device a digitized motor signal indicative of at least one of motor current and motor voltage and a digitized sensor signal. Digitizing of the motor signal and sensor signal is preferably performed by the embedded A/D converter of the microcontroller.

The preferred controller is further operable to detect pulses in the digitized motor signal during a time interval of motor armature rotation and to detect pulses in the digitized sensor signal during a time interval of sheet material roll rotation. The time intervals of digitized sensor signal and digitized motor signal pulse detection need not be identical. Most preferably, the controller is operable to detect pulses in the digitized motor signal after current supply to the motor is deactivated. The microcontroller can also be configured to detect the digitized motor signal while current is supplied to the motor.

The preferred controller determines the rotational speed of the motor from the digitized motor signal and determines the rotational speed of the sheet material roll from the digitized sensor signal. The controller further compares the rotational speeds and controls the dispenser to provide the low-material state indication when the comparison reaches a threshold representative of a low-material state. In an embodiment, the comparison is a determination of the ratio of the rotational speeds and the indicator is activated when the ratio of the sheet material roll speed to the motor speed exceeds a preset threshold.

Preferably, the controller is operable to measure a time interval of motor armature rotation between detected pulses. It is highly preferred that the motor pulse detection comprises detecting three contiguous pulses and the time interval measurement comprises measuring the time between the first and last of the contiguous pulses.

A highly preferred sensor type is a bar code sensor which senses a bar code on the sheet material roll. It is highly preferred that the sheet material is wound on a core and the bar code is located on a core inner surface. It is preferred that the bar code sensor is on a support for the roll. A preferred bar code sensor may include an optical source operable to direct optical energy toward the bar code and an optical detector operable to receive optical energy from the bar code to generate the sensor signal.

The low-material indication controlled by the controller may include activation by the controller of any indicator capable of indicating the low-material state. It is preferred that the low-material indicator is a visual or audible indicator. A lamp visible to a person responsible for replacing the sheet material roll is a suitable type of visual indicator. A light-emitting-diode (LED) is a particularly preferred type of lamp. Other indications, such as dispensing a shortened sheet material length in the next dispense cycle, could be implemented.

A preferred method of indicating that a supply of sheet material on a roll is low comprises digitizing a motor signal indicative of at least one of motor current and motor voltage and a sensor signal indicative of sheet material roll rotation, detecting pulses in the digitized motor signal during a time interval of motor armature rotation and determining the rotational speed of the motor therefrom, detecting pulses in the digitized sensor signal during a time interval of sheet material roll rotation and determining rotational speed of the sheet material roll therefrom, comparing the rotational speeds, and providing an indication when the comparison reaches a threshold representative that the supply of sheet material on the roll is low. The preferred indication is activating an indicator which alerts the attendant that the material is low.

Other objects, advantages and features will become apparent from the following specification when taken in conjunction with the accompanying drawings.

BRIEF DESCRIPTION OF THE DRAWINGS

The invention may be understood by reference to the following description taken in conjunction with the accompanying drawings, in which like reference numerals identify like elements. The drawings are not necessarily to scale, emphasis instead being placed upon illustrating the principles of the invention. In the accompanying drawings.

Figure 1:
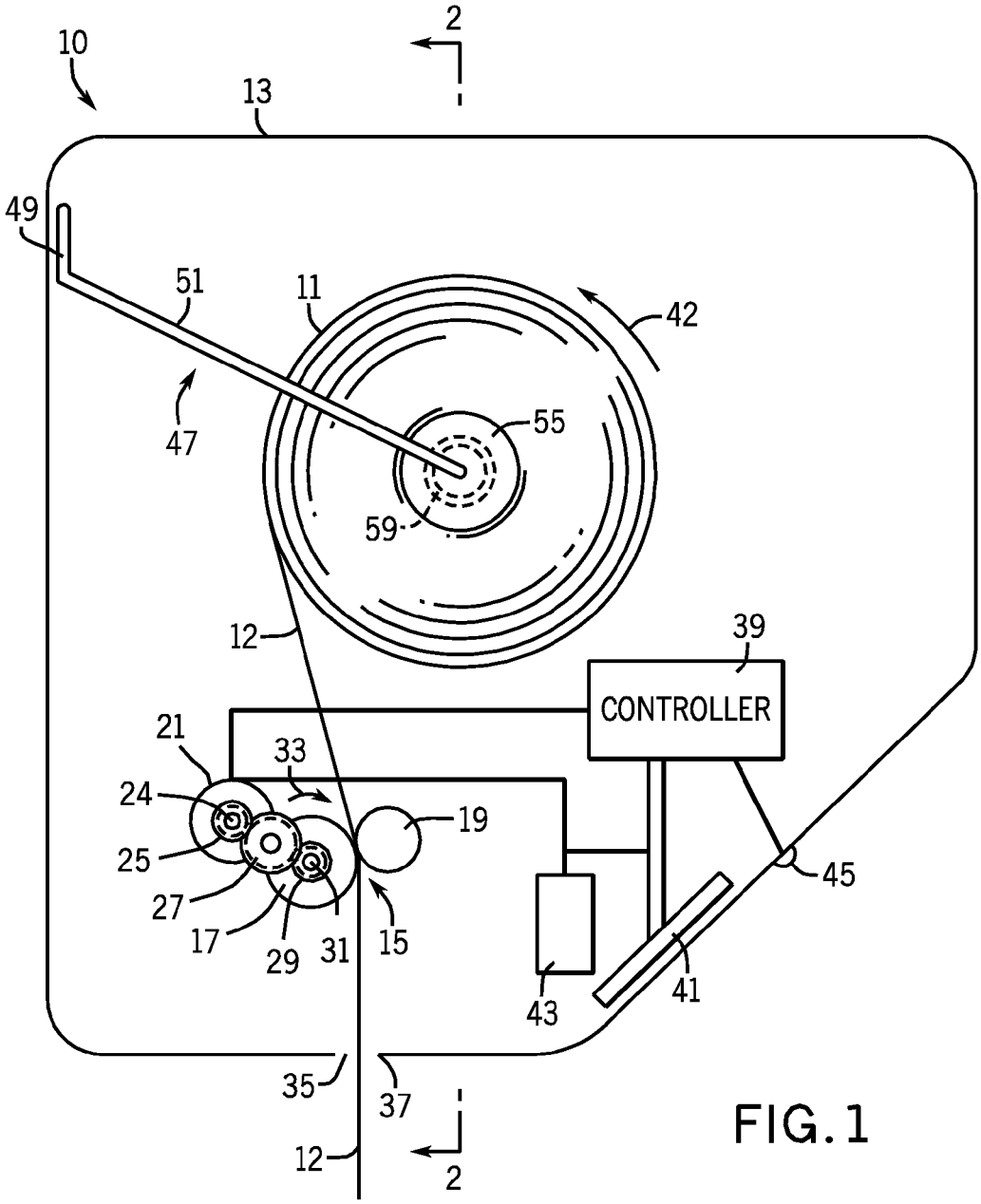
FIG. 1 is a simplified diagram of a sheet material dispenser, in the form of a paper towel dispenser, taken along section 1-1 of FIG. 2 in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

While the present invention may be embodied in any of several different forms, the present invention is described here with the understanding that the present disclosure is to be considered as setting forth an exemplification of the present invention that is not intended to limit the invention to the specific embodiment(s) illustrated. Nothing in this application is considered critical or essential to the present invention unless explicitly indicated as being "critical" or "essential."

Figure 2:
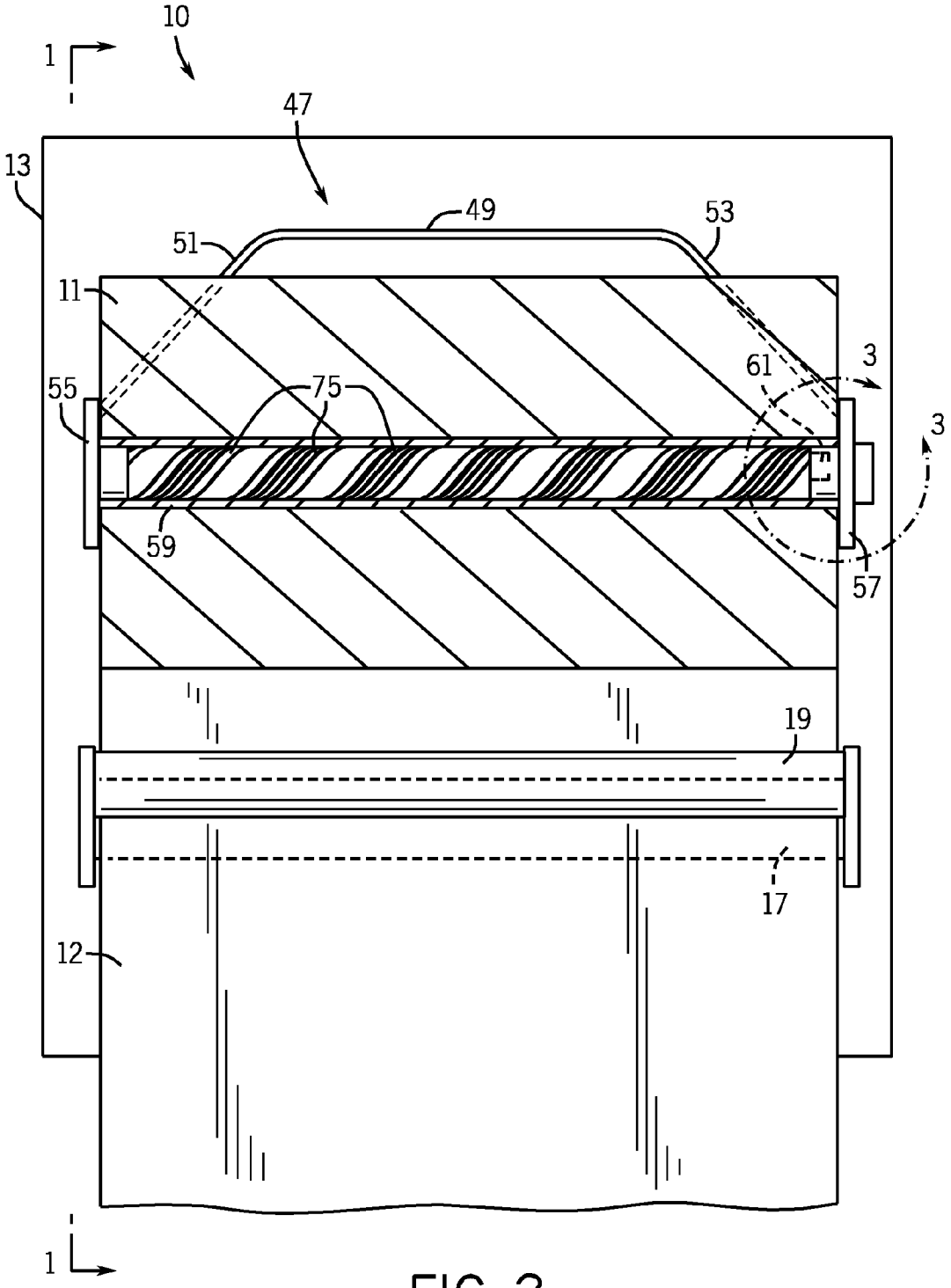
FIG. 2 is a simplified diagram of the exemplary dispenser taken along section 2-2 of FIG. 1.

Referring first to FIGS. 1-6, simplified diagrams of a sheet material dispenser 10 and a sheet material roll 11 in accordance with one embodiment of the present invention are provided. The exemplary sheet material dispenser 10 shown in these figures is a paper towel dispenser which dispenses sheet material 12 in the form of paper towel from a paper towel roll 11. While the exemplary dispenser 10 is described herein as a paper towel dispenser, it will be apparent to a person of skill in the art that dispenser 10 may dispense sheet material other than paper towel 12. Other materials which could be dispensed from dispenser 10 could include toilet tissue, kraft paper, cotton-based cloth, plastic sheet, films, and the like. Dispenser 10 could be configured to dispense tickets, receipts and other sheet-form material. The arrangement of the components in the paper towel dispenser 10 illustrated in FIGS. 1 and 2 are merely exemplary and are not intended to represent an actual physical implementation.

Dispenser 10 includes a low-material sensing system. The dispenser 10 low-material sensing system determines that a low-material state exists and provides an indication to alert an attendant that the sheet-material roll 11 supplying material 12 (e.g., paper towel) to the dispenser 10 is nearly or fully depleted of material and must be replaced with a full roll. The indication informs the attendant that a full roll is required without the necessity to manually open the dispenser 10 to view the amount of material remaining.

The parameters defining a low-material state can be determined and set based the needs of the party providing the dispenser 10 for users. For example, some dispenser providers may wish to define the low-material state as including relatively more material remaining on the roll 11 than would other dispenser providers. The low-material sensing system described herein may be designed to activate the low-material indicator to accommodate these potentially different needs; there is no particular amount of material depletion required before activation of the low-material indicator.

Referring to FIGS. 1-7, exemplary paper towel dispenser 10 includes a roll 11 of paper material 12 supported in a housing 13. Paper 12 is pulled though a nip 15 formed by a drive roller 17 and a tension or "nip" roller 19 which is biased toward drive roller 17 by springs (not shown) or the like. A direct current (DC) motor 21 has an armature 23 with an output shaft 24 to which gear 25 is attached. Gear 25 on output shaft 24 meshes with intermediate gear 27 and intermediate gear 27 meshes with drive roller gear 29 which is mounted on drive roller shaft 31. Motor 21 powers gears 25, 27, 29 resulting in rotation of drive roller 17 in the direction of arrow 33. Accordingly, motor 21 is in power-transmission relationship with drive roller 17. A linkage other than gears 25, 27 and 29 may be utilized. Gears 25, 27 and 29 collectively provide a reduction-gear arrangement in this example.

Paper 12 from roll 11 is dispensed through a slot 35 in housing 13. One edge 37 of slot 35 may have a serrated surface to cut paper 12 as a user grasps paper 12 extending beyond slot 35 and pulls the paper 12 into contact with the serrated surface on edge 37.

Figure 7:
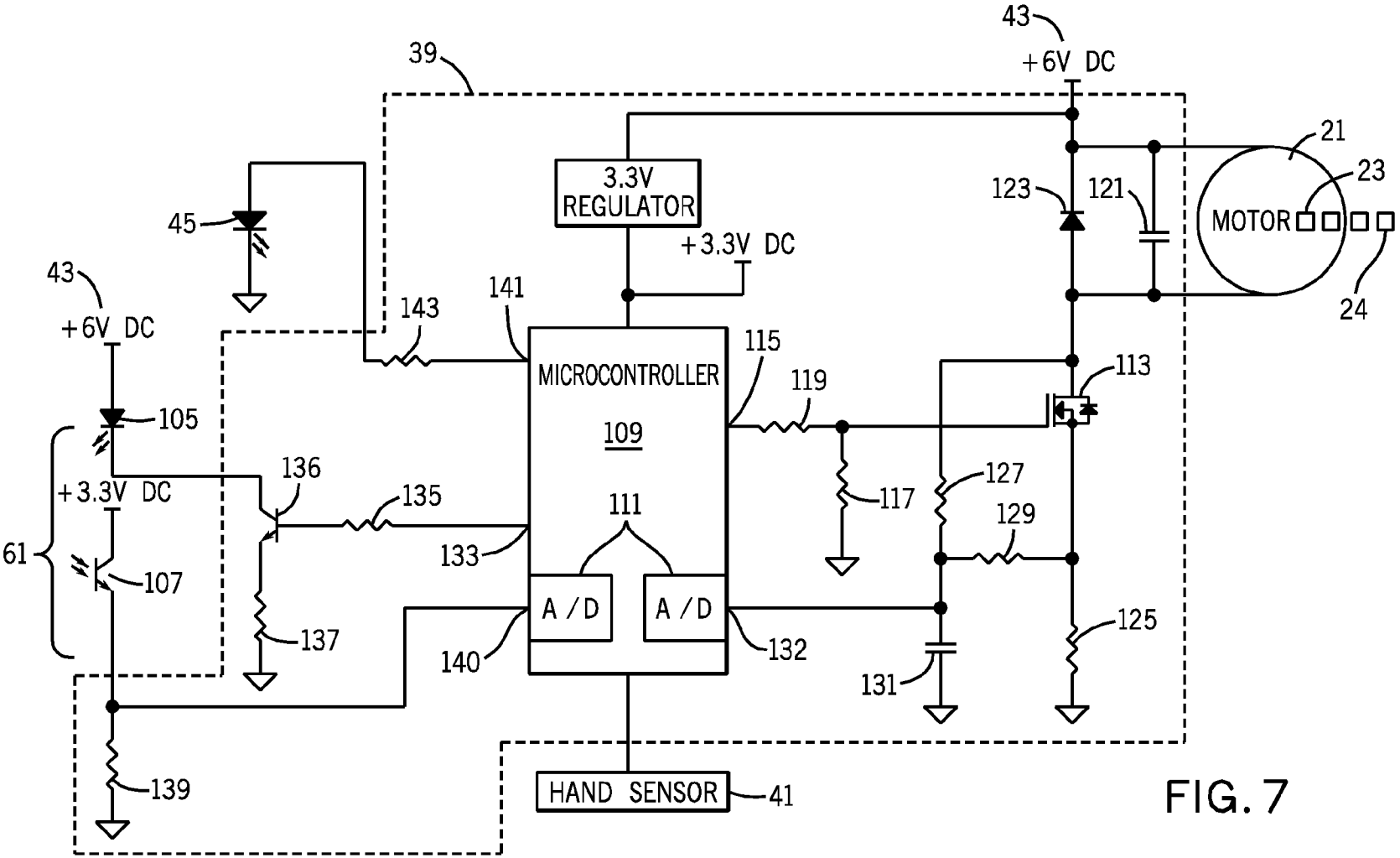
FIG. 7 is a circuit diagram of an exemplary control system that may be used with the dispenser of FIGS. 1-4.

Referring to FIGS. 1 and 7, controller 39 receives an input from a proximity sensor 41 and controls current to motor 21. Once current is supplied to motor 21, motor 21 is activated to power drive roller 17 rotation to pull paper 12 through nip 15 and to dispense a length of paper 12 from dispenser 10. Accordingly, motor 21 produces movement of paper 12 when current is supplied to motor 21 under control of controller 39 resulting in rotation of roll 11 in the direction of arrow 42. Preferably, the paper 12 length dispensed in each dispense cycle is approximately 12 inches, although the length can be set based on the preference of the party providing the dispenser 10 for use.

A representative proximity sensor 41 which may be used to detect the presence of a user's hand is described in U.S. patent application Ser. No. 11/566,465 (Rodrian), the contents of which are incorporated herein by reference. A contact switch (not shown) operated by a push button or the like (not shown) on housing 13 could be used in place of proximity sensor 41.

A battery 43 is preferably provided for powering components such as the motor 21, controller 39, proximity sensor 41, and indicator 45. Indicator 45 is activated by controller 39 to provide the low-material indication in the illustrated example. A preferred indicator 45 is a lamp. A preferred lamp is a light-emitting diode (LED). Indicator types, in addition to, or other than, a viewable LED-type lamp 45 may be used. For example, an audio emitter could be used to provide an audible signal indicative that dispenser 10 is in the low-material state. Other indications, such as controlling motor 21 to shorten or lengthen the sheet material dispensed in subsequent dispense cycles relative to the standard length (e.g., 12 inches), could be implemented. A DC power source, such as an AC-powered DC power supply, may be utilized in place of battery 43.

A support 47 is provided to support roll 11 in dispenser 10. Referring to the example of FIGS. 1-4, support 47 may include a yoke 49 attached in a suitable manner to housing 13. Yoke 49 includes arms 51, 53 and roll holders 55, 57. Arms 51, 53 are preferably made of a resilient material so that they may be easily spread apart to insert roll holders 55, 57 into a core 59 of roll 11, permitting free rotation of roll 11 on support 47.

Referring to FIGS. 2-4 and 7, a sensor 61 is provided on roll holder 57 to generate a signal when roll 11 is rotated on roll support 47. The signal output by sensor 61 is referred to herein as a "sensor signal." Sensor 61 is operably connected to controller 39 and is powered by battery 43 or other DC power source. The sensor signal is received by controller 39 during a time interval of roll 11 rotation, and controller 39 determines the roll 11 rotational speed from the sensor signal. The rotational speed of roll 11 is identical to the rotational speed of core 59 and is referred to herein as core 59 speed. Speed refers to distance (or angular displacement) traveled during a period of time. Core 59 speed is data utilized by controller 39 to determine, or sense, the low-material state of dispenser 10 and to activate indicator 45, thereby alerting the attendant that roll 11 is nearly or fully depleted of paper 12 and must be replaced with a full roll 11.

The sensor signal output by sensor 61 during roll 11 rotation may also be used for the further purpose of recognizing roll 11, thereby permitting dispenser 10 operation with a roll 11 from an authorized source. One such roll recognition system is as described in U.S. Pat. No. 7,040,566 (Rodrian et al.), the contents of which are incorporated by reference. Operation of dispenser 10 with a recognized roll 11 advantageously permits use of paper 12 or other forms of sheet material which are optimized for use with the dispenser 10. The recognition that sensor 61 may be used for both roll 11 recognition and as part of a low-material sensing system represents an opportunity to provide the useful low-paper sensing capability without the necessity of additional hardware providing an opportunity for an additional feature without an increase in product cost. Exemplary sensor 61 structure is described more fully below in connection with FIGS. 3-4 and 7 and the roll support structure 47 roll holder 57.

Referring now to FIGS. 2-3, 5-6, and 8-8A, those figures show an exemplary roll 11 of paper towel 12 wound on a core 59 and a machine-readable code 75 on core 59. In the example, code 75 is a bar code capable of detection by sensor 61 for purposes of sensing a low-material state of roll 11 and/or roll 11 recognition. Exemplary core 59 is preferably a hollow cylindrically-shaped tube including ends 67, 69 and core inner and outer surfaces 71, 73. Core 59 may be manufactured in any suitable manner and of any suitable material. In the example shown, core 59 is a cardboard core common in the paper-converting industry. Core 59 consists of a helically-wound lamination of paper sheets. Core 59 may be made of materials other than cardboard, including plastic and the like.

In the example, bar code 75 is located on core 59 inner surface 71. In the example, there are four repeated copies of bar code 75 on core inner surface 71. No particular bar code 75 quantity required. In the example, sensor 61 is in a fixed position on roll holder 57 and bar code 75 is sensed by sensor 61 as roll 11 rotates. In the example, each bar code 75 consists of a series of varying width bars 77 and spaces 79 which are the elements of bar code 75. A relatively larger space referred to as a quiet zone 81 exists between adjacent copies of the bar code 75 for a purpose described herein. For convenience, FIGS. 8A and 9A include text indicating the location of the bars 77, spaces 79 and quiet zones 81 (abbreviated QZ). This exemplary form of bar code 75 is described in greater detail below in connection with FIGS. 8, 8A, 9 and 9A.

Figure 3:
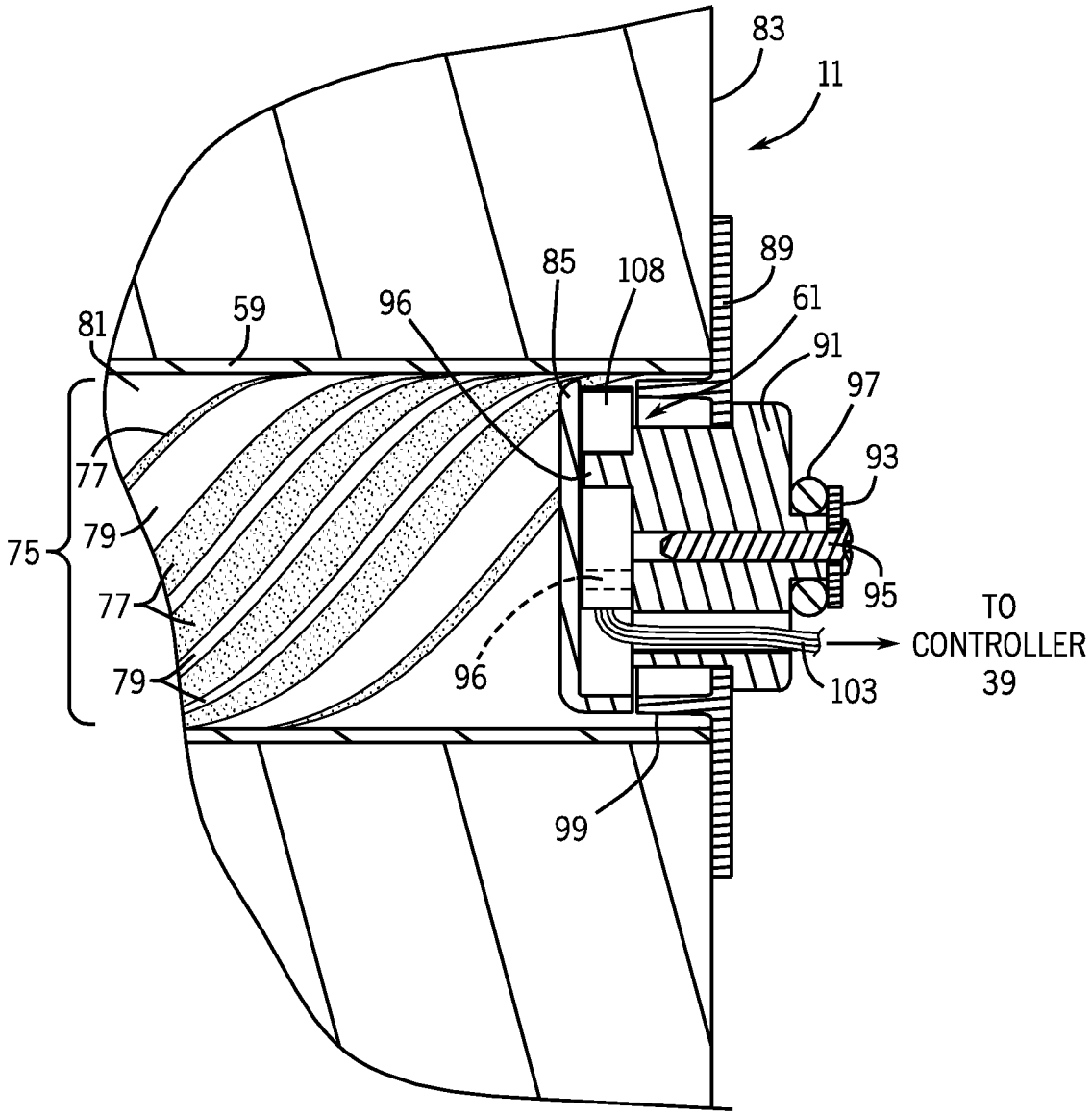
FIG. 3 is an enlarged partial view of an exemplary roll holder and sensor taken along section 3-3 of FIG. 2.
Figure 5:
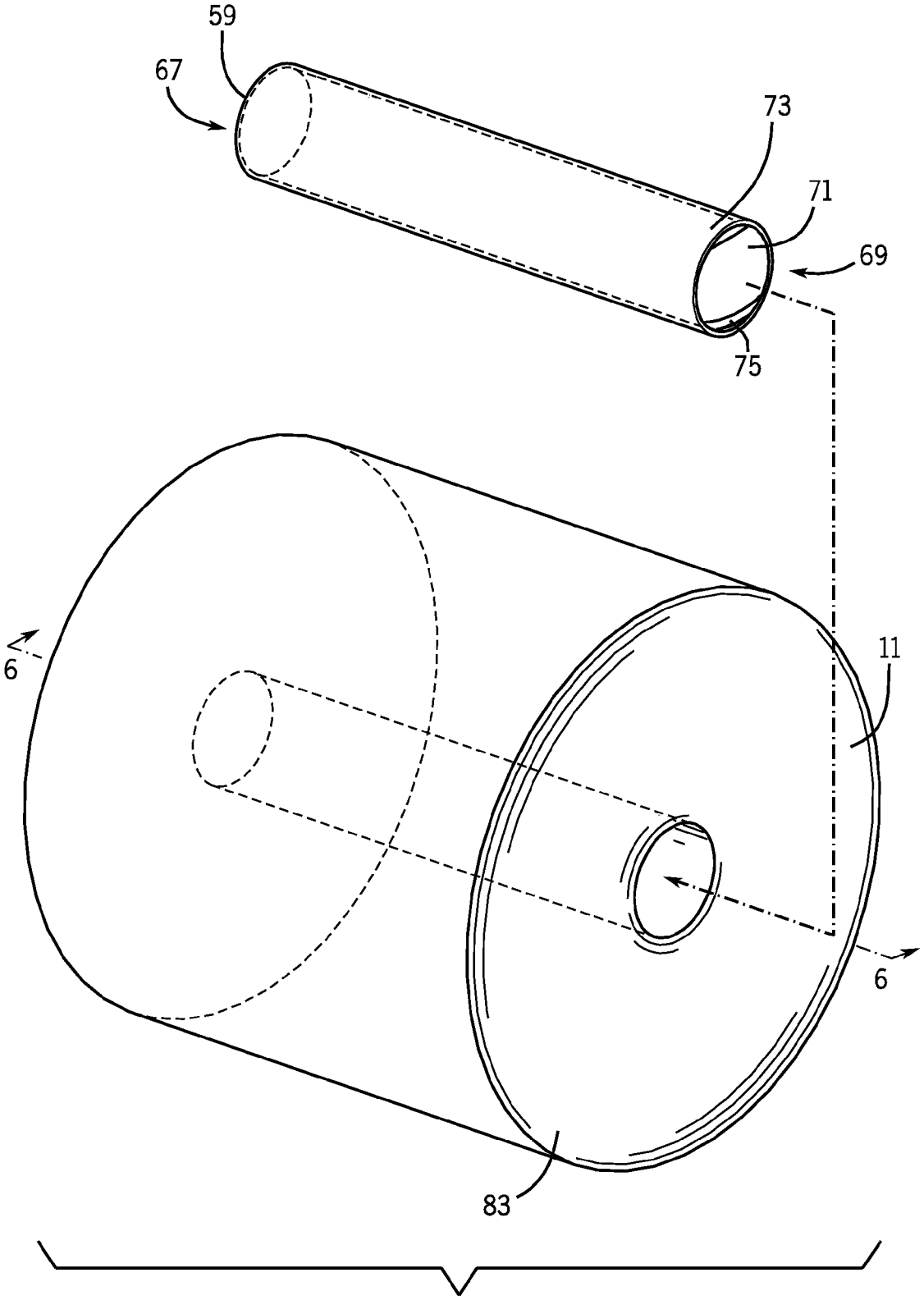
FIG. 5 is an exemplary sheet material roll, in the form of a paper towel roll, wound on a core which includes a machine-readable code.
Figure 6:
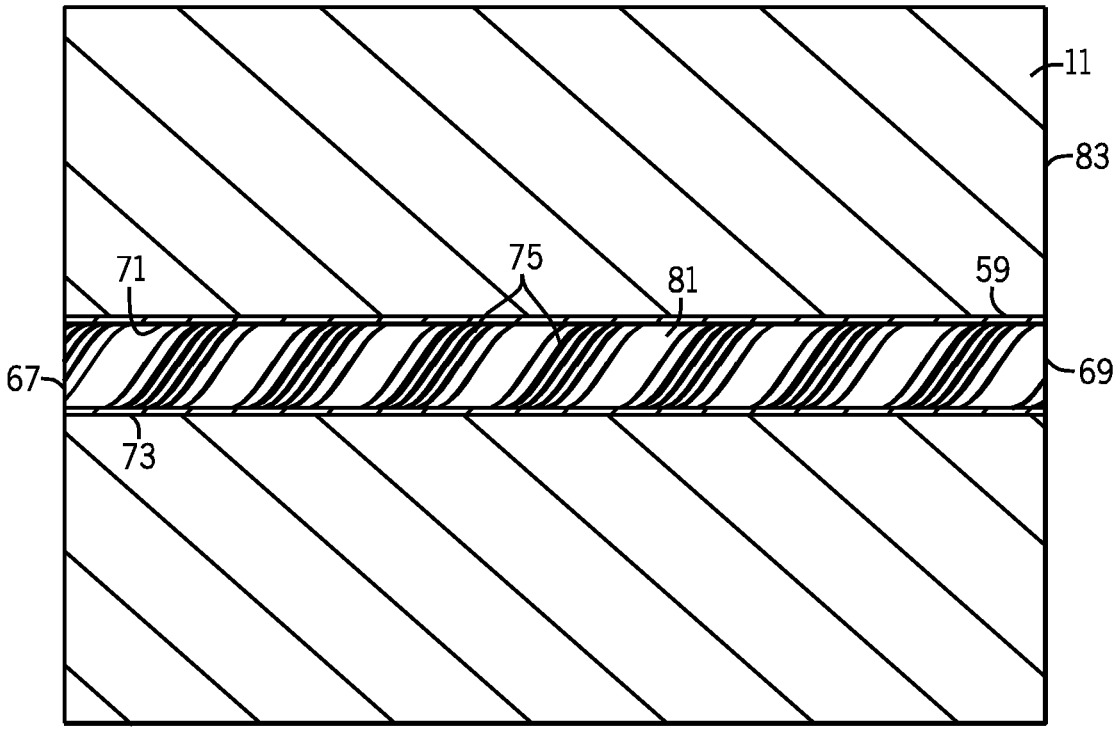
FIG. 6 is the sheet material roll taken along section 6-6 of FIG. 5.

Referring to FIGS. 3 and 5-6, each bar code 75 is preferably printed on the paper used to form core 59 during core manufacture. Bar code 75 on core 59 has a helical appearance consistent with the helical winding of the paper forming core 59. This helical arrangement of bar code 75 is advantageous because it permits efficient manufacture of core 59 with each bar code 75 being uniformly positioned along the axial length of core 59 while using mass production processes commonly used in the sheet-material industry.

The placement and orientation of bar code 75 with respect to roll 11 is limited only insofar as bar code 75 must be in a position capable of being sensed by sensor 61. Therefore, and by way of example only, exemplary bar code 75 may be positioned: (a) in a helically-disposed pattern as shown in FIGS. 2-3 and 5-6, (b) concentrically about the center of the core 59 inner surface 71 along core end 69 (or end 67), or (c) along an edge surface 83 of roll 11. Bar code 75 need not be printed on core 59 and could, for example, be provided in the form of an adhesive-backed tag affixed to core 59.

Figure 4:
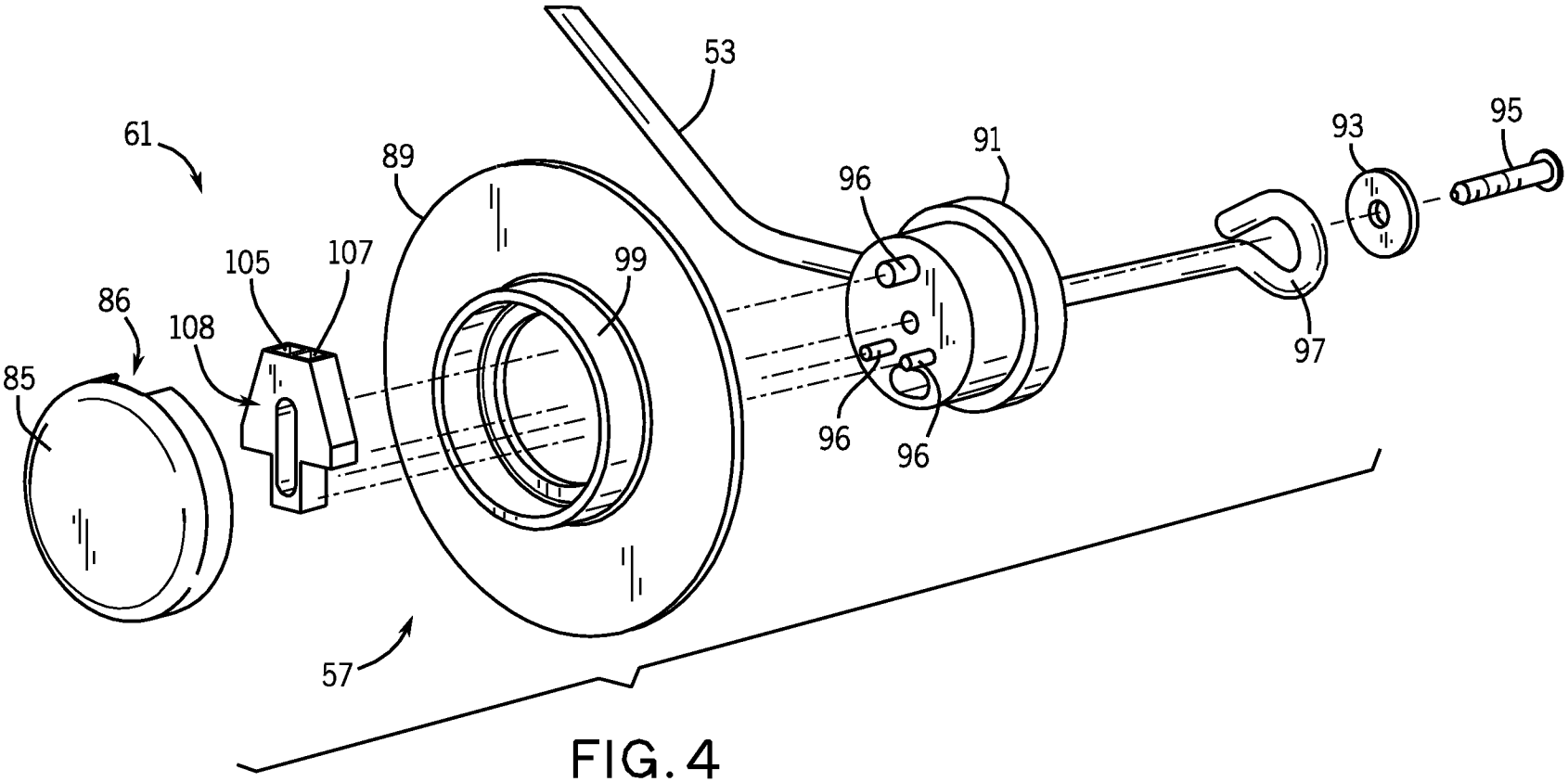
FIG. 4 is an exploded view of the roll holder and sensor of FIG. 3.

FIG. 4 provides an exploded illustration of an exemplary roll holder 57 and sensor 61 supported thereon. In the example, roll holder 57 includes cover 85 with an opening 86, sensor 61, hub 89, base 91, washer 93 and fastener 95. Base 91 is secured by fastener 95 inserted through arm 53 eyelet 97. Base 91 is in fixed-position relationship to arm 53. Pins 96 secure sensor 61 to base 91 by means of a friction fit and are received into corresponding female openings (not shown) in cover 85 to secure cover 85 to base 91 also by means of a friction fit. Sensor 61 is in fixed-position relationship to base 91. Hub 89 includes a neck 99 sized to be received in core 59 end 69 to support core 59 when mounted on yoke 49 and roll holders 55, 57. Hub 89 is rotates easily on base 91 for co-rotation with core 59 as roll 11 rotates within dispenser 10. Roll holder 55 may be a mirror image of roll holder 57, but would not necessarily include a sensor 61.

Referring further to FIG. 4 and to FIG. 7, sensor 61 includes sensor source 105 and sensor element 107. Sensor source 105 is preferably a discrete infrared laser LED such as an Optek Technology brand OPV332 device. Sensor element 107 is preferably a phototransistor device. A suitable phototransistor 107 is an OP506B phototransistor also available from Optek Technology. The sensor element 107 and sensor source 105 are mounted side-by-side on a converging optical axis in a plastic housing 108 directed toward sensor cover opening 86. Sensor 61 is oriented such that sensor source 105 and sensor element 107 are fixed in place and spaced from core 59 inner surface 71. This arrangement orients sensor 61 to scan a bar code 75 during roll 11 rotation on roll holders 55, 57.

The sensor signal output by sensor apparatus 61 corresponding to bar code 75 is typically an analog voltage signal representative of the amount of IR radiation reflected from bar code 75 as the bars 77, spaces 79 and quiet zones 81 (e.g., FIGS. 8A, 9A Bars 1-6, Spaces 1-5 and quiet zones QZ) which pass in front of sensor element 107 as roll 11 rotates in the direction of arrow 42. The analog sensor signal is received by controller 39 and is digitized by analog-to-digital converter 111. The analog signal corresponding to a bar code 75 is a time-varying voltage based on bar code 75 bar and space 77, 79, 81 elements. This time variation is used by controller 39 to determine the core 59 speed for purposes of sensing the low-material state as described below.

If a roll-recognition capability is included in the dispenser 10 and if bar code 75 is not present on core 59 or is a bar code which includes an unauthorized or incorrect code, then the sensor signal output by sensor 61 will be recognized by controller 39 as an invalid signal. Controller 39 then prevents proper operation of dispenser 10. For example, controller 39 could prevent powering of motor 21 as described in U.S. Pat. No. 7,040,566.

While dispenser 10 is shown with sensor 61 comprising a bar code sensor system with an optical emitter and detector (e.g., sensor source 105, sensor element 107), it is envisioned that other types of sensor apparatus 61 could be utilized to detect types of machine-readable indicia other than a bar code 75 associated with roll 11, provided that sensor 61 is capable of detecting roll 11 rotation during a dispense cycle. Other suitable sensor apparatus 61 could include, for example, a magnetic sensor adapted to detect the presence of magnetic ink or other magnetic object on roll 11 or a capacitive field disturbance/proximity detector detecting objects embedded in roll 11.

Referring next to FIG. 7, there is shown a circuit diagram of an exemplary control circuit and system which controls dispenser 10 operation. The control system includes controller 39 and the related circuit components shown in FIG. 7 including microcontroller 109. Microcontroller 109 is programmed with software instructions for implementing the functions described in greater detail below.

Microcontroller 109 receives signals from proximity sensor 41 representing a request for a sheet of paper towel to be dispensed. Microcontroller 109 turns motor 21 "on" in response to signals output from proximity sensor 41 in this embodiment.

Figure 10:
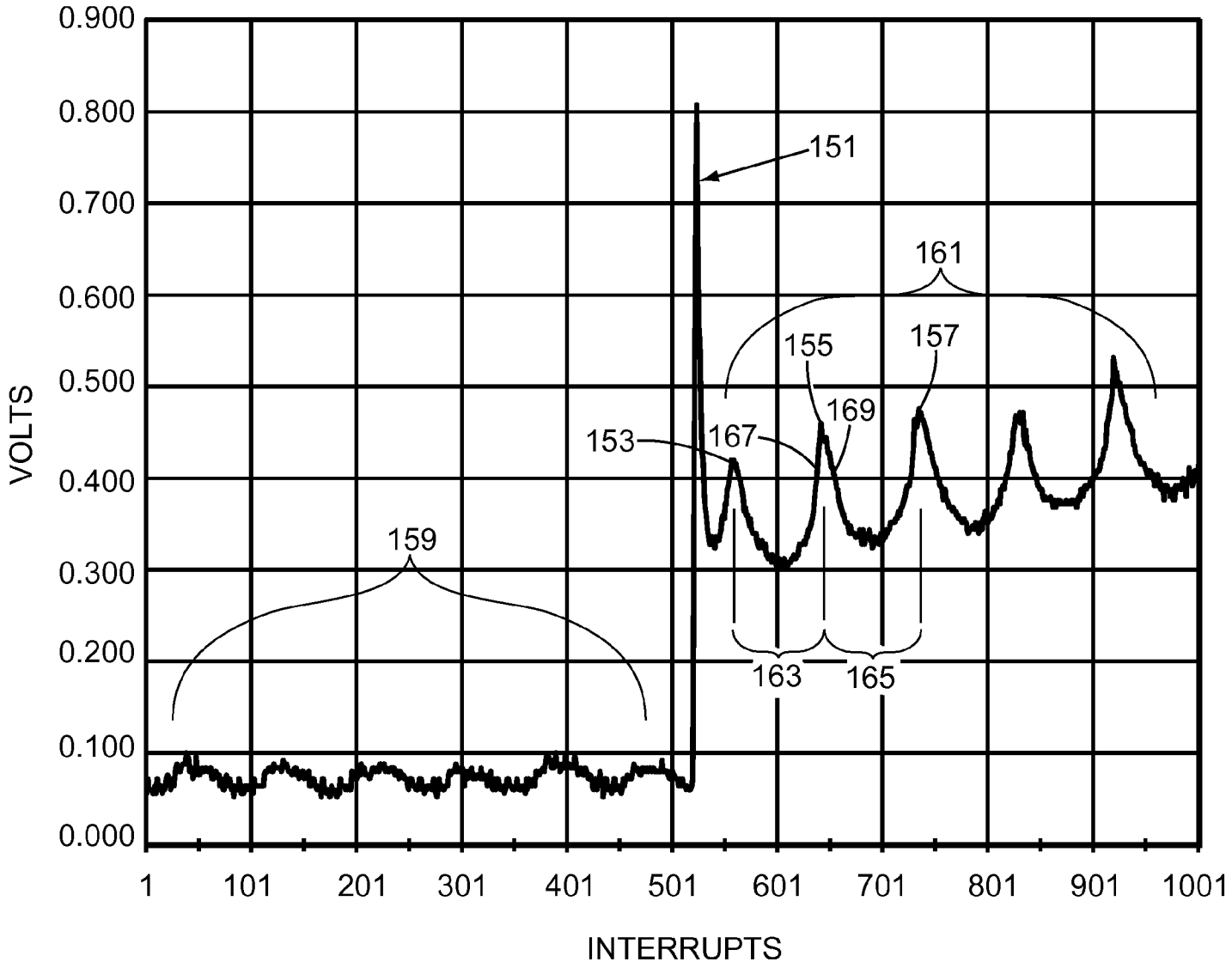
FIG. 10 is a graph illustrating a digitized motor signal during powered motor operation and, subsequently, during motor armature coasting after the motor is depowered.

Microcontroller 109 includes an integrated analog-to-digital (A/D) converter 111 that is connected to a "motor signal" output from motor 21 both during powered motor 21 operation and when motor 21 armature 23 is coasting after current supply to motor 21 is deactivated by controller 39. The motor signal from motor 21 is indicative of at least one of motor current and voltage. The motor signal is also referred to herein as the motor current (Im) and the digitized motor signal is also referred to herein as the digitized motor current. A/D converter 111 measures the motor signal digitally. FIG. 10 illustrates such an exemplary digitized motor signal. A/D converter 111 further receives and digitizes the "sensor signal" output from sensor 61.

Microcontroller 109 employs the data collected by the A/D converter 111 to detect the pulses in both (1) the digitized motor signal (i.e., digitized motor current) resulting from armature 23 rotational displacement and (2) the digitized sensor signal. Microcontroller 109 further determines the motor 21 speed during a time interval of motor armature 23 rotation based on the digitized motor signal pulses and determines the core 59 speed during a time interval of roll 11 rotation based on the detected sensor signal pulses. Thus, motor 21 speed is determined using information in the motor signal, and sheet material roll 11 speed is determined using information in the sensor signal in the example.

Microcontroller 109 compares the rotational speeds of the motor 21 and core 59 and activates the indicator 45 when the comparison reaches a threshold representative of a low-material state. This strategy provides for accurate sensing of the low-material state because the comparison is most preferably based on steady-state speeds of motor 21 and core 59, thereby avoiding potential errors associated with displacement-type detectors which may not control for supply roll 11 overspin resulting from inertia.

In addition, the microcontroller 109 employs the data collected by the A/D converter 111 to detect the pulses in the digitized motor signal (i.e., digitized motor current) and turn the motor 21 "off" once the required quantity of pulses have been detected. As described for example in connection with FIGS. 11A-11D and FIG. 12, microcontroller 109 may be configured to implement differing pulse detection techniques depending on the particular characteristics of the system in which it is employed. An exemplary microcontroller 109 suitable for performing the functions described herein is a model number MSP430F2132 offered commercially by Texas Instruments, Inc.

Controller 39 includes a field effect transistor 113 connected to an activation output terminal 115 of the microcontroller 109 for activating the motor 21. A resistor 117 is provided to ensure that the transistor 113 is deactivated after a reset of the microcontroller 109 before its I/O ports are initialized. A resistor 119 limits short-term oscillation that may occur at the input of the transistor 113 when it is activated. A capacitor 121 is coupled across the terminals of the motor 21 to reduce radiation of RF energy due to brush noise (commutator switching noise) in the motor 21. A diode 123 is also provided across the motor terminals to suppress a voltage spike (FIG. 10, pulse 151) that may occur when the motor 21 is turned off.

Controller 39 further includes a first current-sensing resistor 125 which is provided to generate a voltage proportional to the motor current when the motor 21 is activated through the transistor 113. A second current-sensing resistor 127 bypasses the transistor 113 and generates a voltage proportional to the motor current when the motor 21 is turned off, and the first current-sensing resistor 125 is isolated by the transistor 113. The resistors 127, 129 and capacitor 131 are provided to act as a low-pass anti-aliasing filter on the motor signal (i.e., motor current) input to A/D converter 111 at input terminal 132. The resistors 125, 127, and 127 provide a speed-sensing apparatus for producing the motor signal indicative of motor 21 speed. The motor signal (i.e., motor current) is received by A/D converter 111 and is digitized by A/D converter 111 for determination of motor 21 speed by microcontroller 109.

In the example, sensor 61 is connected to microcontroller 109 of controller 39 as follows. Sensor source 105 (a discrete infrared laser LED in this example) is connected to battery 43 and transistor 136. Transistor 136 in combination with resistors 135 and 137 form a constant current source connected to output terminal 133 of microcontroller 109 to activate the source 105. Sensor element 107 (a phototransistor in this example) is connected to battery 43 and A/D converter 111 of microcontroller 109 through resistor 139. The analog sensor signal output from sensor element 107 is a current that passes through resistor 139 to generate an analog voltage signal that is applied to the A/D converter 111 input terminal 140. This analog voltage signal is digitized by A/D converter 111 for determination of core 59 speed by microcontroller 109.

Indicator 45 is connected to controller 39 at an activation output terminal 141 of the microcontroller 109 for activating the indicator 45. A resistor 143 of controller 39 is provided to limit the current that flows through indicator 45.

Battery 43 powers operation of controller 39, motor 21, indicator 45, and sensor 61.

Figure 8:
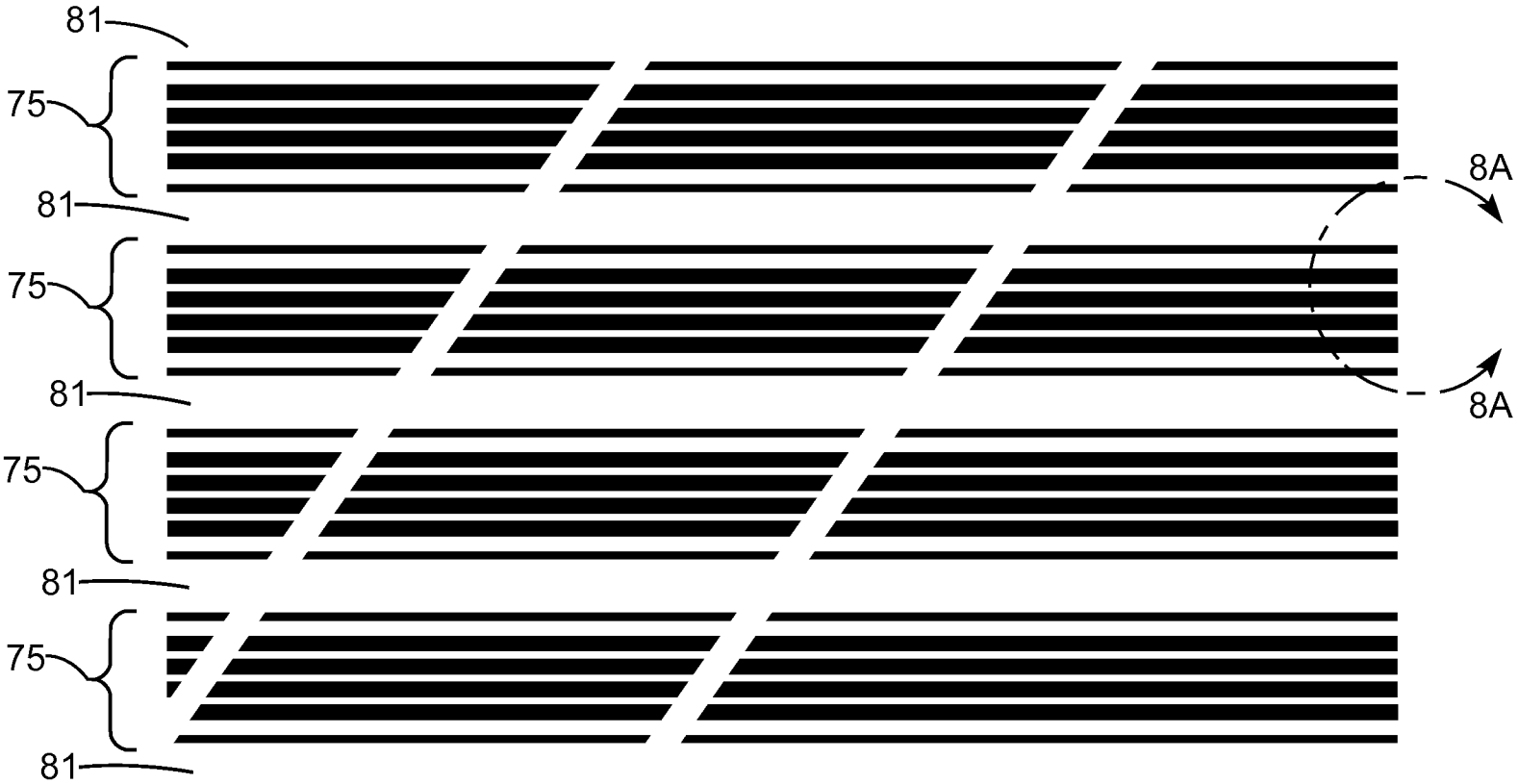
FIG. 8 are plural copies of an exemplary bar code provided on a core inside surface as seen in an unrolled state.
Figure 8A:
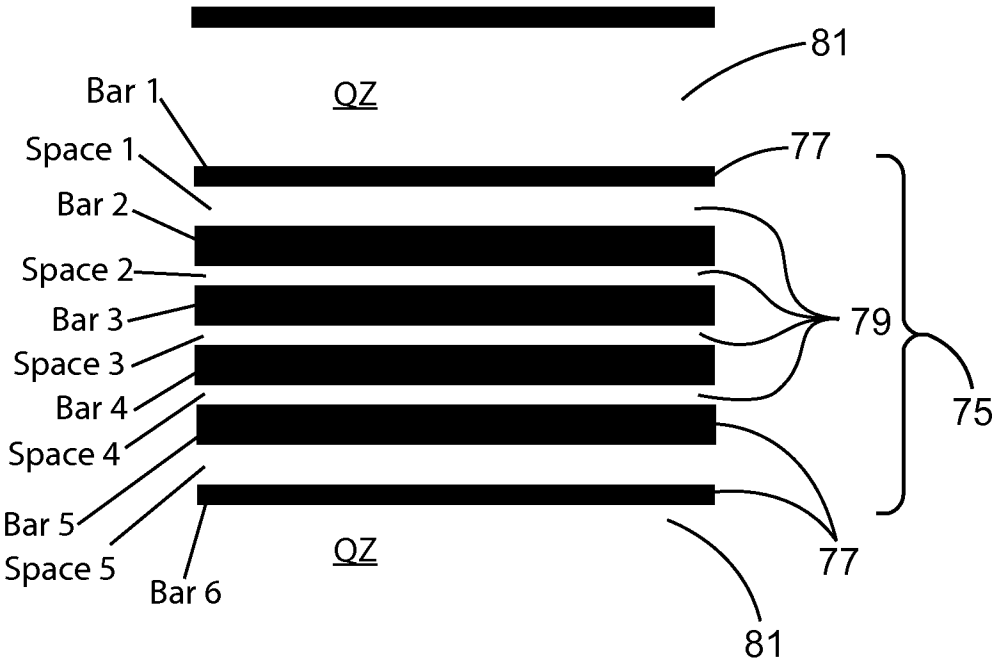
FIG. 8A illustrates an enlarged portion of the bar code taken along section 8A-8A of FIG. 8.
Figure 9:
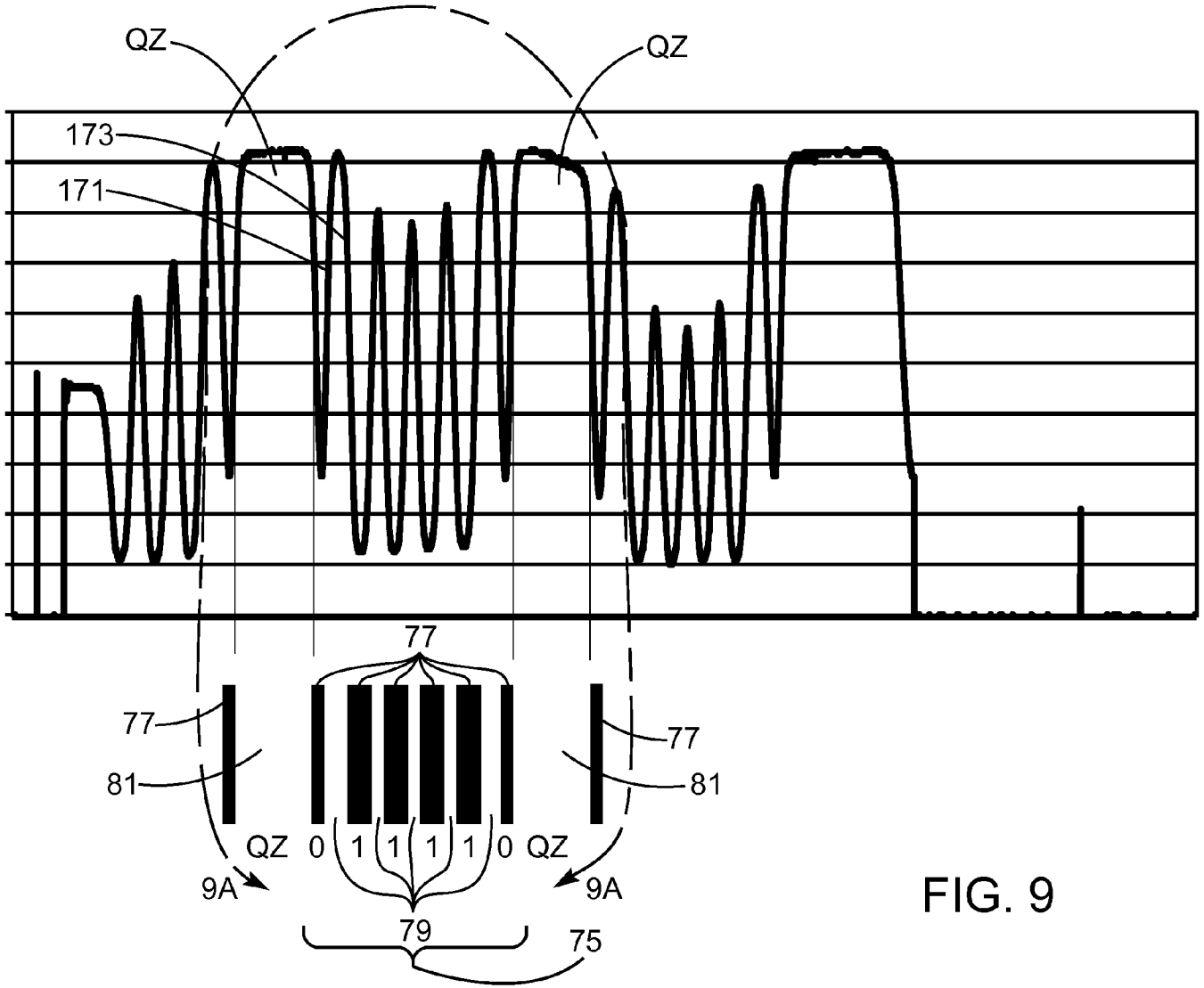
FIG. 9 is the bar code of FIG. 8A together with a graph illustrating a digitized sensor signal corresponding such bar code.
Figure 9A:
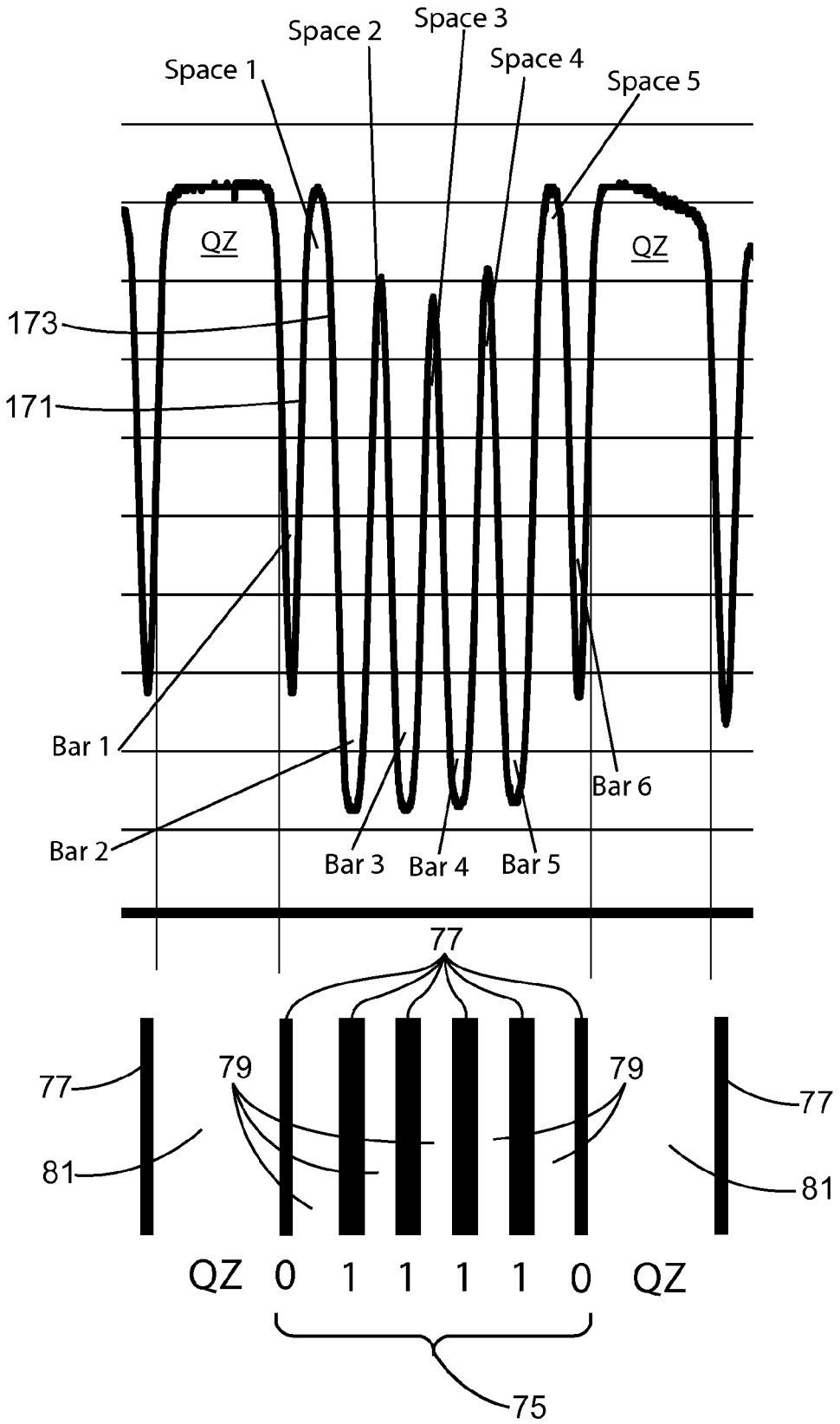
FIG. 9A illustrates an enlarged portion of the bar code and graph taken along section 9A-9A of FIG. 9.

The structure of exemplary bar code 75 will now be explained in greater detail with reference to FIGS. 8-9A. FIGS. 8-9A illustrate a preferred form of bar code 75 applied to the inside of core 59 of roll 11, but as each code 75 would appear in an unrolled two-dimensional state. FIG. 8 illustrates the inner paper sheet of core 59 in a two-dimensional state. FIG. 8A illustrates an enlarged region of FIG. 8. To facilitate understanding of how the digitized sensor signal output from A/D converter 111 corresponds to bar code 75, FIGS. 8A and 9A are labeled so that each bar 77 is indicated as one of Bar 1 through 6 and each space 79 is designated as one of Space 1 through 5.

In this embodiment of bar code 75, bar code 75 is repeated such that four copies of bar code 75 are printed on core 59 as illustrated in FIG. 8. Between each copy of bar code 75 is the relatively wider space quiet zone 81 region, referred to as a QuietZone in the logic flow diagrams of FIGS. 11A-12.

In FIGS. 8, 8A, 9 and 9A, each copy of bar code 75 consists of six bars 77 (Bar 1 through Bar 6) and five spaces 79 (Space 1 through Space 5). Quiet zone 81 (QZ) is located between the copies of bar code 75.

The information represented by bar code 75 is contained within the relative widths of the bars 77 (Bars 1-6) and spaces 79 (Spaces 1-5). For convenience, reference terms Bar 1 through Bar 6 are used herein to indicate both the bars themselves and the widths of the bars such that the statement "the width of Bar 1 equals the width of Bar 6" can also be written as Bar 1=Bar 6. In this embodiment, bar code 75 is symmetrical around its center such that Bar 1=Bar 6, Bar 2=Bar 5, Bar 3=Bar 4, Space 1=Space 5, and Space 2=Space 4." Also in this embodiment of bar code 75, a logical "0" is represented by a "narrow" bar, a logical "1" is represented by a "wide" bar, and the width of "narrow" and "wide" spaces is equal to those of "narrow" and "wide" bars, respectively. "Wide" bars and spaces are twice the width of "narrow" bars and spaces, and a "narrow" space follows a "wide" bar for Bar 1 to Bar 3 when viewed in the forward direction (Bar 1 to Bar 2 to Bar 3), and the same is true for Bar 4 to Bar 6 when viewed in the reverse direction (Bar 6 to Bar 5 to Bar 4). Bar code 75 in FIG. 8 therefore represents the six-digit binary number 011110 as indicated on FIGS. 9-9A. Since the bar code is symmetrical in this embodiment of bar code 75, there are only eight ($2^3$) possible unique values of the three-digit binary number (half of the six-digit bar code 75).

FIGS. 9 and 9A show the digitized sensor signal resulting from roll 11 rotation once the sensor signal output from sensor 61 is digitized by A/D converter 111 and is processed by bar-code-detection logic 290 on board microcontroller 109 as shown and described below in connection with FIG. 11C. Exemplary bar code 75 is superimposed in FIGS. 9 and 9A to illustrate the digitized sensor signal portions corresponding to the bar code 75 bars 77 (Bars 1-6), spaces 79 (Spaces 1-5) and QuietZones 81 (QZ).

FIGS. 11A through 11D illustrate one embodiment of a low-material sensing system for use with exemplary paper-towel-type sheet material dispenser 10. FIGS. 11A through 11D are flow diagrams of the logic of a programmed set of instructions in microcontroller 109 firmware which control the material dispensing and low-material sensing processes.

Before describing the exemplary logic of FIGS. 11A-11D in detail, a brief overview is provided to facilitate understanding.

Figure 11A:
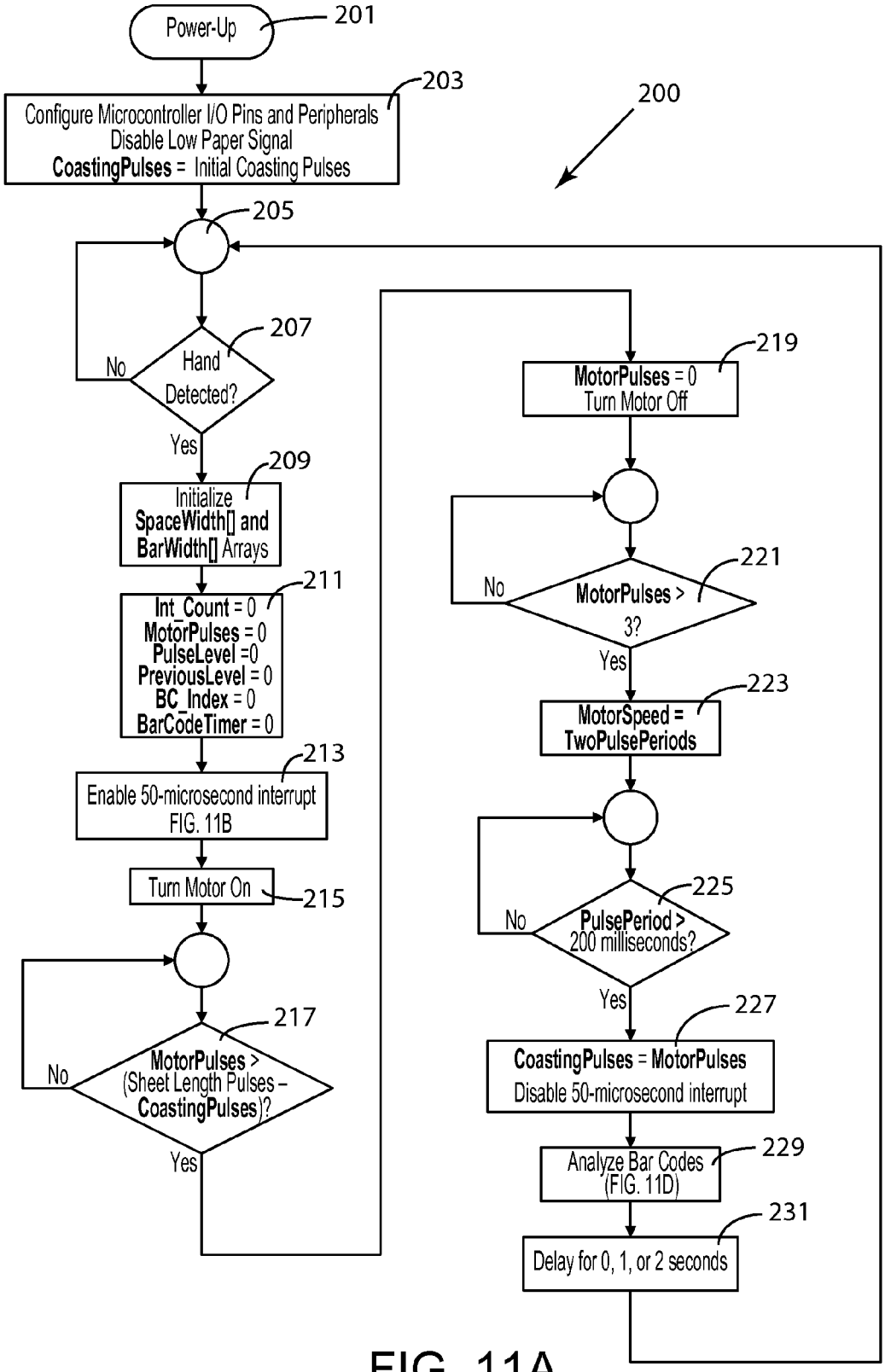
FIGS. 11A-11D are logic flow diagrams of the general logic implemented by the controller to control the dispenser embodiment of FIGS. 1-4 and 7.

FIG. 11A illustrates the logic of the main control loop 200. A portion of the logic of main control loop 200 generates a value for a variable which represents the speed of motor 21 armature 23, also referred to herein as motor 21 speed. Motor 21 speed is subsequently used in FIG. 11D to determine whether the low-material state exists. In the embodiment of FIG. 11A, the motor-speed determination is made utilizing motor pulses which occur while the motor 21 is coasting. In an alternative embodiment described in connection with FIG. 12 and FIGS. 11B-11D, the motor 21 speed determination may be made utilizing motor 21 pulses generated while current is supplied to the motor 21.

Figure 11B:
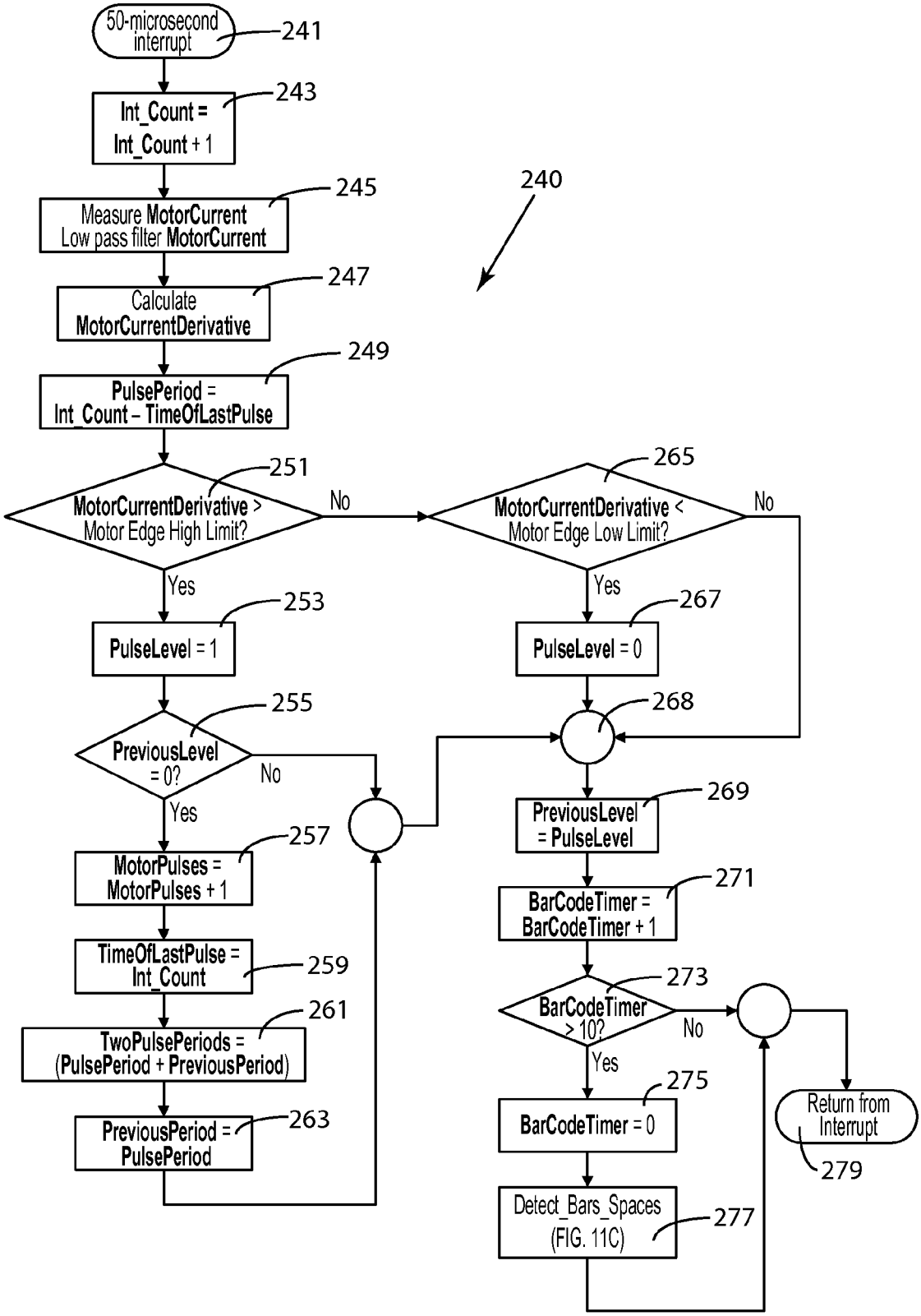

FIG. 11B illustrates an embodiment of the interrupt logic 240 which operates when an interrupt is enabled (element 213) once in each dispense cycle within main control loop 200 of FIG. 11A. The enabling causes an interrupt event to occur repeatedly every 50 microseconds (μs), until the interrupt is disabled (element 227) at the end of a dispense cycle. Each interrupt event (element 241) causes execution of the logic described in FIG. 11B. During the interrupt, motor pulses are detected during a time increment for the motor 21. Speed determination and bar-code-detection logic 290 in FIG. 11C occurs for determining the speed of roll 11 and core 59 rotation during a time increment, also referred to herein as core 59 speed.

Figure 11C:
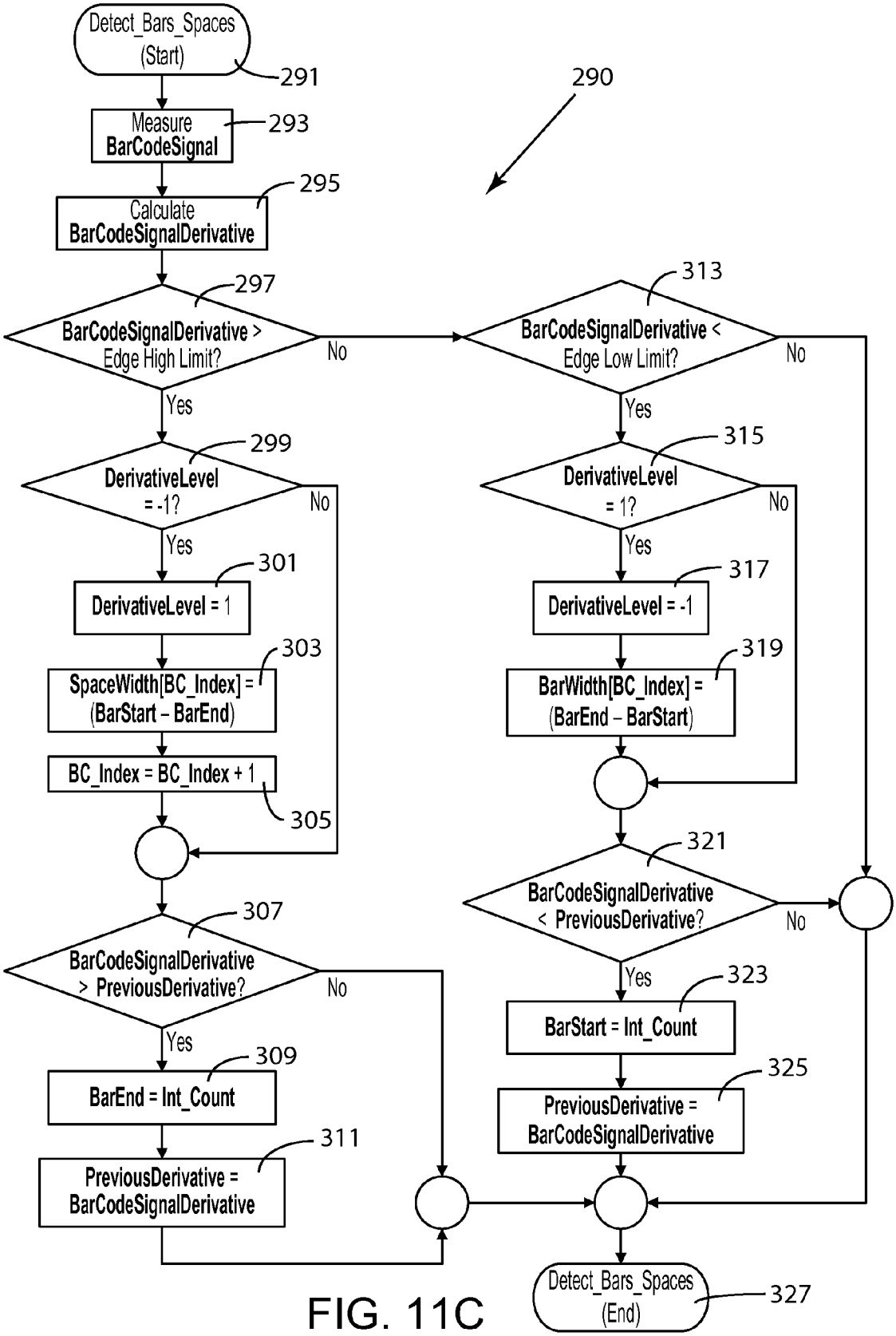

FIG. 11C illustrates an embodiment of bar-code-detection logic 290 which operates within interrupt logic 240 (FIG. 11B, enabled at element 277) to generate information representing the relative widths of the bars and spaces of bar code 75 in core 59 of roll 11. This information is subsequently used in FIG. 11D to determine the speed of roll 11 and core 59 rotation.

Figure 11D:
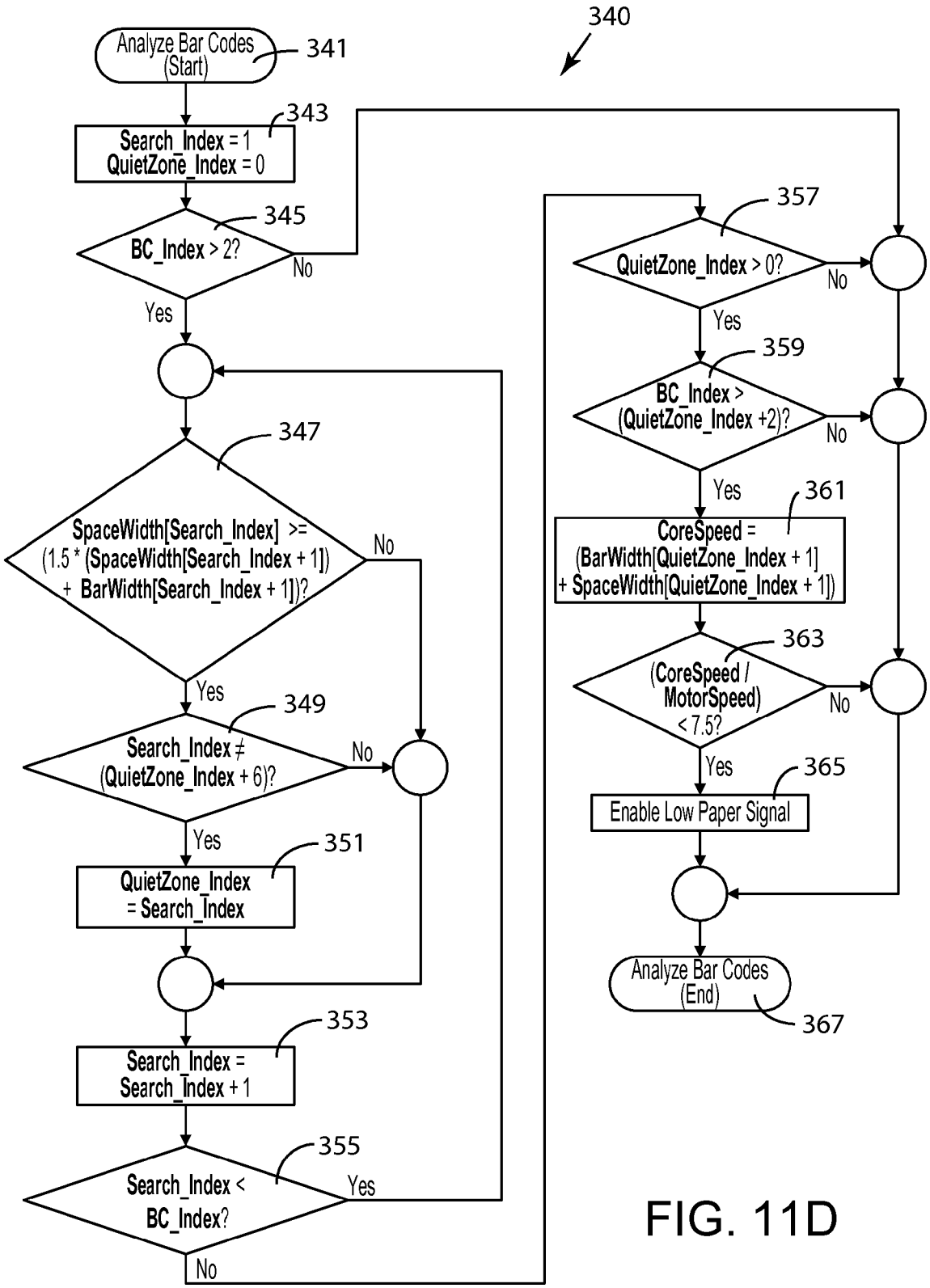

FIG. 11D illustrates an embodiment of the bar-code-analysis logic 340 with which the bar code information produced by bar-code-detection logic 290 (FIG. 11C) is analyzed (a) to generate a measure of core 59 speed, (b) to compare this core 59 speed with the motor 21 speed value generated by main control loop 200 in FIG. 11A, and (c) to activate indicator 45 indicative of the low-material state occurring when roll 11 is near depletion.

In the description of the flow diagrams (FIGS. 11A-D and 12) which follow, the following nomenclature is used. For purposes of brevity, nomenclature definitions are provided with reference to FIG. 11A, it being understood that the definitions apply to like elements of all flow diagrams.

Referring to FIG. 11A as an example, boxes with curved sides, such as logic element 201, are start or termination elements and represent entry or exit points within the logic flow. Rectangular boxes, such as logic element 203, represent functional elements within the logic flow. Diamond-shaped boxes, such as logic element 207, represent decision elements in the logic flow. In each decision element, two logic flow paths emerge, one for a "YES" decision and one for a "NO" decision. Small circular logic elements, such as logic element 205, are connection elements in which the various logic flow paths which are connected at such logic elements are joined to continue the flow from the common point of such connection element. The direction of logic flow is indicated by arrowheads on the logic flow paths. In the flow diagrams of FIGS. 11A-11D and 12, bold text is used to represent variables and non-bold text is used to represent quantities which are constant within the operation of the logic flow.

Referring now to FIG. 11A, the function of main control logic 200 is (a) to initialize many of the variables used in microcontroller 109, (b) to capture a user-request for a sheet of paper towel 12 thereby initiating a dispense cycle, (c) to turn motor 21 "on" and "off" to dispense the proper length of paper towel 12, (d) to determine a value of motor armature 23 speed (for use in determining whether or not the supply of paper towel 12 on roll 11 is nearly depleted, i.e., the low-material state), and (e) to manage the other portions of logic which are used to control dispenser 10 as illustrated in FIGS. 11B-11D and described in detail below.

Referring then to FIG. 11A and element 201, main control logic 200 begins at element 201 with controller 39 being powered up.

In functional element 203, a start-up routine is carried out which initializes the I/O pins and the devices connected to microcontroller 109 and resets low-material indicator 45. In this embodiment, part of the function of controller 39 is to control the length of material dispensed during each dispense cycle. In functional element 203, an initial value Initial Coasting Pulses representing the length of material dispensed during coasting (after the deactivating of motor 21) is loaded into the variable CoastingPulses. How this variable is used to control material length is discussed below. Once dispenser 10 start-up routine is complete in element 203, dispenser 10 is ready for detection of a user's hand, indicative of a user request for a sheet of paper towel 12.

In decision element 207, detection by proximity detector 41 of a user's hand adjacent dispenser 10 is determined. If a hand is detected, a "YES" decision is made within decision element 207 and the logic flow continues to element 209. If the presence of a hand is not detected, a "NO" decision is generated and the logic flow continues to interrogate hand-detection in a short logic loop around decision element 207 until a "YES" decision is generated.

When the presence of a user's hand is detected in decision element 207, the logic flow proceeds to initialize to 0 two arrays of variables SpaceWidth[ ] and BarWidth[ ] in functional element 209 and a number of variables in functional element 211. Array SpaceWidth[ ] is a one-dimensional list (vector) of values which, when loaded, contains time intervals which represent the widths of the spaces 79 (Spaces 1-5) in bar code 75. In a similar fashion, BarWidth[ ] is a one-dimensional list (vector) of values which, when loaded, contains time intervals which represent the widths of the bars 77 (Bars 1-6) in bar code 75.

Referring further to the initialization in functional element 211, the variable Int_Count is set to 0. Int_Count is a variable which is used to count the number of interrupts encountered. In this embodiment, interrupts occur every 50 μs and provide the time base information for controller 39.

Referring further to element 211, MotorPulses is a variable which is used to count electrical pulses generated by motor 21 as described above. PulseLevel of element 211 is a variable which is either a logical "0" ("low" indicates the absence of a motor pulse) or a logical "1" ("high" indicates the presence of a motor pulse). PreviousLevel is a variable which is set in the logic to the previous value of PulseLevel. BC_Index is a pointer variable which is used to indicate which entry in the BarWidth[ ] and SpaceWidth[ ] arrays is being used at a point in time within the logic flow.

Also in element 211, the variable BarCodeTimer is set to 0.

BarCodeTimer is a counter variable which causes execution of the logic 290 of FIG. 11C once every ten, 50 microsecond interrupts in elements 273, 275 and 277. That is, the logic 290 of FIG. 11C is executed every 10*50 microseconds, which is once every 500 microseconds.

Referring to functional element 213, following initialization in functional elements 209 and 211, main control loop 200 enables the 50 μs interrupt timer allowing interrupts to occur, interrupting the logic flow every 50 μs when enabled. Whenever an interrupt occurs, at whatever point in the logic flow the process happens to be, the logic within interrupt logic 240 in FIG. 11B is carried out and control then returns to the point in the logic at which the interrupt occurred.

Referring further to FIG. 11A and logic elements 215, 217 and 219, these elements carry out the function of turning motor 21 "on" and "off" in a dispense cycle in order to dispense a proper length of paper towel 12. In the example, turning the motor 21 "on" and "off" is accomplished by counting pulses generated by motor 21 while motor 21 is powered and, subsequently, during motor 21 coasting (i.e., after current supply to motor 21 is deactivated by controller 39). A benefit of the low-material sensing system embodiment described herein is that an existing motor-control system can be adapted to perform part of the low-material sensing, thereby eliminating unnecessary and costly additional parts and reducing the cost of dispenser 10 manufacture.

After the 50 μs interrupt is enabled in functional element 213, controller 39 activates the supply of current to motor 21 in element 215, beginning the dispensing of a paper towel 12. In this embodiment of controller 39, a preset length of paper towel is dispensed and the preset length of towel is represented by pulses generated by motor 21 both while motor 21 is powered and while it is coasting after controller 39 deactivates current supply to motor 21.

In decision element 217, the logic determines whether the motor 21 has been activated sufficiently to dispense the preset length of towel 12 in the dispense cycle. In the example, motor 21 is deactivated when counted motor 21 pulses during motor operation equal a value representing pulses required for a full sheet minus coasting pulses from the preceding dispense cycle.

Referring further to element 217, the preset length of paper towel to be dispensed is the constant Sheet Length Pulses. While motor 21 is being powered, the variable MotorPulses is used to count (within interrupt logic 240 of FIG. 11B) the number of motor pulses which occur during this motor-powered period. Thus, MotorPulses represents how much paper towel has been dispensed during powered motor 21 operation. The variable CoastingPulses in element 217 is also a counter-timer, used to represent the amount of towel which is dispensed after current supply to motor 21 is deactivated. The CoastingPulses value used during a dispense cycle to estimate the length of towel dispensed is the value stored in microcontroller 109 memory from the preceding dispense cycle.

In decision element 217, the variable MotorPulses is compared with the preset constant Sheet Length Pulses minus CoastingPulses to determine if motor 21 should be deactivated. As long as the decision is "NO" in decision element 217, the logic flow remains in a short logic loop around decision element 217 while motor 21 is powered and the variable MotorPulses is incremented in interrupt logic 240 (FIG. 11B) during interrupts every 50 μs in element 213 (FIG. 11A). The value of MotorPulses increases as the length of paper towel 12 pulled through nip 15 by motor-powered operation of drive roller 17 increases.

Referring again to functional element 217, when the value of MotorPulses is greater than the difference of Sheet Length Pulses minus CoastingPulses, a "YES" decision is reached and motor 21 is depowered. In element 219, the variable MotorPulses is reset to 0, initializing the value of MotorPulses which will then be used to determine the value of CoastingPulses for the next dispense cycle.

Referring now to element 221, motor 21 speed is next determined once current to motor 21 is deactivated by controller 39 and a fourth motor pulse has been detected. In this embodiment, motor 21 speed is the steady-state speed determined once motor 21 is coasting. During coasting, motor 21 behaves as a generator. Motor 21 speed is determined by reference to the three pulses 153, 155, 157 following a transition pulse 151 (FIG. 10) which occur immediately after current supply to motor 21 is deactivated in this embodiment.

FIG. 10 is a graph illustrating pulses in a digitized motor signal (i.e., the digitized motor current) used to determine motor 21 speed in this embodiment. FIG. 10 illustrates pulses during powered operation (interval 159) and after current to motor 21 is deactivated when motor 21 is coasting (interval 161) during the 50 μs interrupts occurring while the interrupt is enabled. FIG. 10 shows the digitized motor signal measured in volts across current-sensing resistor 125 when motor 21 is activated (interval 159) or across resistor 127 when current to motor 21 is deactivated (interval 161).

As can be seen in FIG. 10, the motor pulse which is generated immediately after depowering of motor 21 (the transition pulse 151) may provide unreliable time information. Consequently, this embodiment of controller 39 discards transition pulse 151 and uses the three motor pulses 153, 155, 157 during intervals 159 and 161 immediately after transition pulse 151, generated while the motor 21 is coasting, to provide the time information used to compute MotorSpeed.

These three coasting pulses 153, 155, 159 are selected by the short logic loop around decision element 221 which tests the number of pulses which have occurred after motor depowering by comparing the variable MotorPulses, incremented in interrupt logic 240 (FIG. 11B), to the number 3.

In element 223, when MotorPulses is greater than 3, the variable MotorSpeed is set to the time variable TwoPulsePeriods. TwoPulsePeriods varies with the speed of motor 21 but not in the normal fashion. In this case, as the speed of motor 21 is higher, the value of TwoPulsePeriods is lower. Nevertheless, since the final result eventually required in the logic of microcontroller 109 is a comparison of the motor 21 speed with the speed of core 59 (a ratio comparison), this different relationship is suitable and will be described further below. FIG. 10 illustrates these time periods; PulsePeriod is interval 165 and PreviousPeriod is interval 163.

In functional element 225, after the variable MotorSpeed has been set, decision element 225 and the short logic loop around it are used to determine when the speed of motor 21 has slowed sufficiently to estimate how far it has coasted after depowering. When the variable PulsePeriod is longer than 200 milliseconds, the variable CoastingPulses is set in functional element 227 to the number of motor pulses which have occurred during coasting for use during the next dispense cycle to determine paper towel length. At this point (functional element 227), the 50 μs interrupt is also disabled.

At functional element 229 of FIG. 11A, the main control logic 200 branches to the bar-code-analysis logic 340 of FIG. 11D. After bar-code-analysis logic 340 is completed, functional element 231 provides a delay for a preset time to prevent dispenser 10 from dispensing another length of towel 12 immediately after completing the previous dispense cycle. The delay is provided to prevent repeated dispense cycles which could result in waste of the paper towel 12. In FIG. 11A, the preset time choices shown are 0, 1, and 2 seconds but other preset values for the delay may be used. The logic flow then is directed back to functional element 207 of FIG. 11A to wait for the next detection of a user's hand representing the next request for a paper towel 12.

Referring now to FIG. 11B, that figure shows an embodiment of interrupt logic 240 which runs when main control loop 200 is interrupted by the 50 μs interrupt timer in element 213 of FIG. 11A. Interrupt logic 240 provides the information for dispenser 10 control which is based on time. When the 50 μs interrupt is enabled (element 213), the control logic is interrupted every 50 μs and the functions which are carried out are (a) the detection and timing of motor pulses (FIG. 11B) and (b) the measurement of bars and spaces in bar code 75 (FIG. 11B element 277 and FIG. 11C). As is detailed below, bar-code-detection logic 290 in FIG. 11C is performed periodically at the end of certain 50 μs interrupt logic 240 cycles.

In FIG. 11B, the logic flow enters interrupt logic 240 at element 241 and proceeds to increment by 1 the interrupt counter Int_Count in functional element 243. Int_Count provides a count of the number of 50 μs time intervals (and thus a measure of time) during a dispense cycle since it is reset to 0 at the beginning of each dispense cycle. This count is followed in functional element 245 by a measurement of the motor signal (i.e., the motor current) and placing the result into the variable MotorCurrent. The motor signal (i.e., the motor current) is measured by A/D converter 111, and such measurements are used to identify pulses in motor signal (i.e., the motor current) which provide the measurement of distance traveled by motor armature 23.

In this embodiment, the measurement of MotorCurrent in functional element 245 also includes filtering the digital stream of motor signal (i.e., the digitized motor current) measurements from A/D converter 111 with a low-pass filter. As an example, the filter may utilize a filter equation such as:

$$\text{MotorCurrent}(i+1)=\tfrac{7}{8}*\text{MotorCurrent}(i)+\tfrac{1}{8}*\text{MotorCurrent}(i+1).$$

That is, the new filtered value of the variable MotorCurrent (i+1) at time "i+1" is set equal to a weighted sum of the previous filtered value of the variable MotorCurrent(i) at time "i" and the new measured value of MotorCurrent(i+1). Use of such a low-pass filter is not required but may improve motor pulse detection.

Referring again to FIG. 10, the pulses (e.g., pulses 153, 155, 157) in the digitized motor signal (i.e. the digitized motor current) shown in that figure correlate with the rotation of motor armature 23 and thus can be used to infer motor 21 speed. These pulses (e.g., pulses, 153, 155, 157) have rising and falling edges which define the pulses. A rising edge of pulse 155 is identified by reference number 167 and a falling edge of pulse 155 is identified by reference number 169.

In functional element 247, a calculation of the derivative of the motor signal (i.e., the motor current), MotorCurrentDerivative, is used to sense the rising and falling edges (e.g., edges 167, 169) of such pulses (pulses 153, 155, 157). In this embodiment, a "boxcar" derivative calculation is performed using the eight most recent measurements values of MotorCurrent, as follows: MotorCurrentDerivative is equal to the sum of the four most recent values of MotorCurrent minus the sum of the previous four values of MotorCurrent. (No division by a time value is necessary because such time value is always the same, given that the interrupt is occurring at regular 50 μs time intervals.) After the MotorCurrentDerivative is calculated, interrupt logic 240 calculates the elapsed time (PulsePeriod) since the last motor current pulse in functional element 249.

Interrupt logic 240 then proceeds to decision element 251 in which the value of the MotorCurrentDerivative is compared to a preset threshold Motor Edge High Limit. In this embodiment, Motor Edge High Limit may have a value on the order of 50. (MotorCurrent and MotorCurrentDerivative are values of A/D counts, and in this embodiment, A/D convertor 111 has a full-scale of 1023 counts for a full-scale voltage of 1.5 volts.) Thus, decision element 251 is looking for increases of MotorCurrent on the order of 50 or above to indicate that a rising edge (e.g., rising edge 167) is occurring in MotorCurrent. If a "NO" decision is reached in decision element 251, a similar comparison is made in decision element 265 looking for falling edges (e.g., falling edge 169) of motor pulses (pulses 153-157) using a preset threshold Motor Edge Low Limit, which in this embodiment may have a value on the order of −50.

In decision element 251, if MotorCurrentDerivative is found to be above the threshold Motor High Edge Limit, interrupt logic 240 proceeds to set a variable PulseLevel to "1" (logical high) to indicate that a rising edge (e.g., rising edge 167) has been found in the motor current.

In decision element 255, the logic flow branches depending on whether the previous value of PulseLevel (called PreviousLevel) is a "0" or a "1" (logical low or high). If the decision is a "YES" (i.e., this is a new pulse), interrupt logic 240 proceeds to the following steps: (a) MotorPulses is incremented by 1 in functional element 257 to provide a count of motor pulses; (b) a variable TimeOfLastPulse is set to the time value Int_Count in functional element 259; (c) the time variable TwoPulsePeriods is set to the sum of the two most recent values of PulsePeriod (PulsePeriod+PreviousPeriod) in element 261; and (d) the variable PreviousPeriod is set to the current value of PulsePeriod in element 263.

From element 263, the flow of interrupt logic 240 proceeds to connection element 268 which is the same point (connection element 268) at which the logic would have proceeded if a "NO" decision had been reached at decision element 255 (i.e., the rising edge 167 is not in a new pulse 153). Connection element 268 is also reached when the logic flow passes through decision element 265 looking for falling edges within the motor signal (i.e., the motor current).

In decision element 265, if a falling edge (e.g., falling edge 169) is detected (a "YES" decision in element 265 based on comparison of MotorCurrentDerivative with the threshold Motor Edge Low Limit), the variable PulseLevel is set to "0" (logical low) in functional element 267. If no falling edge is detected in decision element 265, no further action is taken and the logic proceeds to functional element 269.

In summary, in the logic 240 of FIG. 11B, the digitized motor signal (i.e. the digitized motor current), MotorCurrent, is continuously analyzed to detect all rising and falling edges (e.g., edges 167, 169). As part of this logic, transition pulse 151 is detected and treated as a "normal" pulse. However, the pulse period (motor speed) associated with this transition pulse 151 is ignored because more than 3 pulses (element 221) must be detected after the motor 21 is turned off before the pulse period information is used to determine the motor speed in element 223 which follows.

In functional element 223 of main control logic 200 (see FIG. 11A), the time interval TwoPulsePeriods is used as the measure of motor armature 23 speed (MotorSpeed). In functional element 269 of interrupt logic 240, the variable PreviousLevel is set to the current value of PulseLevel in order to capture both the current and previous time periods between pulses. As detailed above, the variable TwoPulsePeriods is computed in functional element 261 to then be used in functional element 223 in main control logic 200 (FIG. 11A).

In functional element 271, the counter-timer variable BarCodeTimer is incremented by 1. BarCodeTimer serves as a timer to trigger bar-code-detection logic 290 in FIG. 11C.

In decision element 273, after every 10 interrupt cycles (or 500 μs), decision element 273 redirects interrupt logic 240 to branch to the bar-code-detection logic 290 of FIG. 11C in functional element 277. In element 275, the variable BarCodeTimer is initialized to 0 in preparation for the next such branching.

Termination element 279 is entered either from decision point 273 (after a "No" decision) or from element 277. In termination element 279, the interrupt logic 240 returns to the point from which it was triggered.

Referring next to FIG. 11C, there is shown the logic for detecting bar code 75 within core 59 of roll 11. The detected bar code information is loaded into arrays BarWidth[ ] and SpaceWidth[ ] and is used in the logic 340 of FIG. 11D to determine the rotational speed of core 59 for purposes of activating low-material indicator 45.

Bar-code-detection logic 290 is entered at element 291 and proceeds in functional element 293 to measure the sensor signal from bar code sensor 61 and place the measured value in the variable BarCodeSignal. This digitized measurement is made by A/D converter 111 in a manner similar to the measurement of motor current.

In functional element 295, the derivative of BarCodeSignal is calculated, using the same "boxcar" derivative calculation as is used to calculate a value for MotorCurrentDerivative in functional element 247 within interrupt logic 240 (FIG. 11B). In this embodiment, BarCodeSignal has a rising edge 171 at the beginning of a space 79 and a falling edge 173 at the beginning of a bar 77. FIGS. 9 and 9A illustrate one example of a digitized signal from sensor 61 corresponding to bar code 75 which is processed by bar-code-detection logic 290 shown in FIG. 11C. FIGS. 9 and 9A illustrate a representative exemplary rising edge 171 and a representative falling edge 173.

In decision element 297, the logic seeks to detect bar 77 to space 79 transitions in bar code 75 within the digitized sensor signal output from A/D converter 111. This edge-detection process is similar to the measurements related to motor current. Therefore, after calculation of the BarCodeSignal- Derivative in functional element 295, the bar-code-detection logic 290 proceeds to look for edges in BarCodeSignal in decision element 297, in which the current value of BarCodeSignalDerivative is compared to a preset threshold Edge High Limit. In this embodiment, Edge High Limit may have a value on the order of 70, and in similar fashion in decision element 313, the value of threshold Edge Low Limit may be on the order of −70. If in decision element 297, a rising edge (e.g., rising edge 171) is not detected by the comparison with threshold Edge High Limit, then bar-code-detection logic 290 proceeds to look for a falling edge (e.g., falling edge 173) in functional element 313. If no falling edge is detected in functional element 313, then bar-code-detection logic 290 ends at termination element 327, and the logic flow returns to interrupt logic 240 at functional element 277 in FIG. 11B.

Decision element 299 is entered if a rising edge is detected in decision element 297. In decision element 299, if the value of a variable DerivativeLevel is not −1, the logic flow branches around functional elements 301, 303, and 305. A value of DerivativeLevel of 1 indicates that a rising edge has been detected, and a value of −1 indicates that a falling edge has been detected. Decision element 299 examines the previously-set value of DerivativeLevel to see if a falling edge had been detected the last time the variable DerivativeLevel was set. If a rising edge is detected in decision element 297 and a rising edge had also been detected previous to such detection in element 299, then a branching around functional element 301, 303, and 305 occurs.

In decision element 299, if the value of DerivativeLevel is −1, then the combination of the current rising edge (detected in decision element 297) and the most recent falling edge (confirmed in decision element 299) means that the leading and trailing edges of a space in bar code 75 have been detected.

Then, in functional element 301, the value of DerivativeLevel is set to 1 to indicate the start of a space (end of a bar).

In functional element 303, array entry SpaceWidth[BC_Index] is set to the time interval BarStart-BarEnd.

The values of time (indicated as 50 μs counts) BarStart and BarEnd used in the calculation of SpaceWidth[BC_Index] have been set during previous iterations of bar-code-detection logic 290. The timer-counter variables BarStart and BarEnd are set at points in bar-code-detection logic 290 which are downstream of functional element 303 and will be discussed below. The result of functional element 303 is that the time interval representing the width of a space in bar code 75 is loaded into one entry of the array SpaceWidth[ ].

The index pointer BC_Index is then incremented by 1 in functional element 305 in preparation for loading the next entry into the array BarWidth[ ].

Decision element 307 determines if the value of BarCodeSignal Derivative is a local maximum by comparing its value with its previously-saved value PreviousDerivative. If BarCodeSignalDerivative is found to be greater than its previous value, then the value of time BarEnd is set to the value of Int_Count in functional element 309, and the value of BarCodeSignalDerivative is saved as PreviousDerivative. This is the determination that a bar 77 has ended and a space 79 has started in the sensing process as bar code 75 moves past sensor 61. Put another way, a bar-to-space transition (end of a bar 77 which also is the start of a space 79) or a space-to-bar transition (end of a space 79 which is also the start of a bar 77) occurs at a time equal to the value of the Int_Count variable. (The Int_Count is incremented every 50 microseconds.) The time difference of two edges determines the width of a bar 77 or the width of a space 79.

Bar-code-detection logic 290 ends from decision element 307 or functional element 311, returning logic flow to the end of interrupt logic 240.

Referring again to decision element 297, if the value of BarCodeSignalDerivative is not above threshold Edge High Limit, then BarCodeSignalDerivative is tested against a preset threshold Edge Low Limit in decision element 313 to determine if a falling edge has been reached in BarCodeSignal. If no such edge is detected in decision element 313, bar-code-detection logic 290 ends, returning logic flow to the end of interrupt logic 240.

In decision element 313, if a falling edge is detected, then bar-code-detection logic 290 proceeds through logic elements 315, 317, 319, 321, 323, and 325 in a fashion directly similar to logic elements 299, 301, 303, 305, 307, 309, and 311. In the case of a falling edge, BC_Index is not incremented (no functional element similar to functional element 305 exists). Thus, array BarWidth[ ] sequentially contains each bar width, array SpaceWidth[ ] sequentially contains each intervening space width, and the pair of arrays BarWidth[ ] and SpaceWidth[ ] contain a complete representation (widths represented by time in 50 μs counts) of bar code 75. In this embodiment, array values range from the low 10's to low 100's.

The bar-code-detection logic 290 of FIG. 11C runs whenever it is triggered at functional element 277 (FIG. 11B) within interrupt logic 240. Interrupt logic 240 is disabled in functional element 227 in main control logic 200 when it is determined that a dispense cycle has ended in decision element 225. Then, in functional element 229 of main control logic 200 (FIG. 11A), the bar-code-analysis logic 340 of FIG. 11D is triggered at the end of a dispense cycle.

FIG. 11D illustrates exemplary bar-code-analysis logic 340. The function of bar-code-analysis logic 340 is (a) to use the data in arrays BarWidth[ ] and SpaceWidth[ ] to identify which bar 77 and space 79 will be used to determine the rotational speed of core 59 (CoreSpeed), (b) to determine a value for the variable CoreSpeed, (c) to compare the variable CoreSpeed with the variable MotorSpeed to determine whether or not the supply of paper towel 12 is nearly depleted (i.e., the low-material state), and (d) to control low-material indicator 45 based on this determination, thereby providing an indication of the low-material state.

Referring now to FIG. 11D, bar-code-analysis logic 340 begins with element 341. Then, in functional element 343, a variable Search_Index is initialized to 1, and a variable QuietZone_Index is initialized to 0. These two indices are pointers used in the analysis of the bar code data in the arrays.

In decision element 345, it is determined whether or not the variable BC_Index is greater than 2. The value of BC_Index at this point in the logic flow is equal to the number of bars 77 which have been loaded into array BarWidth[ ]. A value of BC_Index less than 2 indicates that an insufficient number of bars 77 have been detected to make a core 59 speed determination. If insufficient bars 77 have been detected in element 345, bar-code-analysis logic 340 ends at termination element 367, returning the flow of logic to main control logic 200 which proceeds to functional element 231 (FIG. 11A), providing a preset delay before returning to the small logic loop around decision element 207 to wait for the next detection of a user and a request for a towel to be dispensed.

The logic moves to decision element 347 if the value of BC_Index is greater than 2 as determined in element 345. In decision element 347 a determination is made regarding whether or not the current space (i.e., the space width, expressed in 50μ time counts, in SpaceWidth[ ] pointed to by the current pointer value Search_Index) is a QuietZone 81. As explained with respect to FIGS. 8 and 8A, a QuietZone 81 is the wider space between neighboring copies of bar code 75, and in this embodiment, this determination is made by comparing the width of the current space to the sum of one-and-a half times the width of the next space plus the width of the next bar in the arrays. In other words, the exemplary QuietZone 81 width is 50% wider than the width of the adjacent bar 77 plus the width of the adjacent space 79 and this is the minimum width of the QuietZone 81 in the example. Other suitable comparisons may be made, such as simply with a preset threshold width which would be sufficient to define a QuietZone 81.

Logic elements 347, 349, 351, 353, and 355 form a loop which is configured to identify a QuietZone in bar code 75 by identifying the first full QuietZone (reference number 81—see FIG. 8A) after the first entry in array SpaceWidth[ ]. (In this embodiment, the first entry in each array has an index value BC_Index of 0, and functional element 343 assures that the first entry of SpaceWidth[ ] is ignored.)

Decision element 349 identifies full Quiet Zone 81 based on the specific configurational rules of bar code 75 as described above, including the fact that there are six bars 77 between QuietZones 81 in the example. When QuietZone 81 is identified in functional element 347, if it is found in decision element 349 to be six entries away in the array SpaceWidth[ ], then it is determined that the repeated bar codes 75 are being properly sensed and QuiteZone 81 has already been identified. In this case, the value of QuietZone_Index is not set to a new value and the reading of the array SpaceWidth[ ] continues until the full number of spaces has been searched for QuietZones 81. This determination is made in decision element 355. If full QuietZone 81 has been found, then the value of the index QuietZone_Index is set to the current value of Search_Index in functional element 351, and Search_Index is incremented by 1 in functional element 353 to continue the search through the SpaceWidth[ ] array.

When the search for QuietZone 81 is completed, the bar-code-analysis logic 340 continues to decision element 357 in which, if the value of QuietZone_Index is not greater than 0, no calculation of core 59 speed is done since a value of 0 indicates that no full QuietZone 81 was found. If full QuietZone 81 has been found, then decision element 359 is used to filter out situations in which there is insufficient data in the arrays to make a good estimate of the core 59 speed, i.e., there are not at least two pairs of bars and spaces following the selected QuietZone 81.

Functional element 361 calculates the variable CoreSpeed if sufficient data is available as determined in element 359. In element 361, the value of the variable CoreSpeed is set to the sum of the time widths of the first bar 77 (Bar 1 in FIG. 8A) plus the first space 79 (Space 1 in FIG. 8A) immediately after selected QuietZone 81. Because of the requirements on the embodiment of bar code 75 described above, this sum represents a known distance, namely, a narrow bar (logical "0") is followed by a wide space or a wide bar (logical "1") is followed by a narrow space.

Referring next to decision element 363, the ultimate determination is made with respect to whether core 59 speed has exceeded the motor armature 23 speed enough to trigger a low-material indication. Both of the variables CoreSpeed and MotorSpeed are measured in time represented by counts of 50 μs periods of time, CoreSpeed in functional element 361 and MotorSpeed in functional element 223. Higher values of speed are represented by lower values of time for both variables. During a dispense cycle, when roll 11 of paper towel is full, the rotational speed of roll core 59 is slow compared to its rotational speed when roll 11 is nearly depleted of paper 12. Slower speeds translate into longer times. Thus the ratio CoreSpeed/MotorSpeed is decreasing as roll 11 of paper towel is being depleted. Since both of the variables CoreSpeed and MotorSpeed are measured in time, the variables CoreSpeed and MotorSpeed are actually proportional to the inverses of the speed $C_s$ of roll core 59 and speed $M_s$ of motor armature 23, respectively. Thus, the comparison in decision element 363 is equivalent to determining whether or not $C_s/M_s$ is greater than a preset ratio threshold. That is, the determination is whether or not the speed $C_s$ of core 59 has increased relative to the speed $M_s$ of motor armature 23 above a preset ratio threshold.

Now in decision element 363, the ratio CoreSpeed/MotorSpeed is compared to a preset ratio threshold to determine whether roll 11 of paper towel is near depletion and ready to be replaced. In this embodiment, the preset ratio threshold is shown as 7.5. The value of this ratio threshold depends on many factors in both the hardware and software of the embodiment of the invention, and the ratio threshold is chosen accordingly to indicate that roll 11 is nearly depleted and in a low-material state.

In functional element 365, indicator 45 is activated to provide a low-material indication if the speed ratio CoreSpeed/MotorSpeed has reached the preset ratio threshold in decision element 363. If not, no such signal is enabled.

At termination element 367, the bar-code-analysis logic 340 ends, and the flow of logic returns to main control logic 200 at functional element 231 (FIG. 11A) awaiting detection of the user's hand indicative of the next request for a towel at decision element 207 as described above.

Note that in this embodiment, the extra bar-and-space pair required by decision element 359 simply ensures that the bar 77 and space 79 used for the speed calculation are not the very last bar 77 and space 79 measured.

Figure 12:
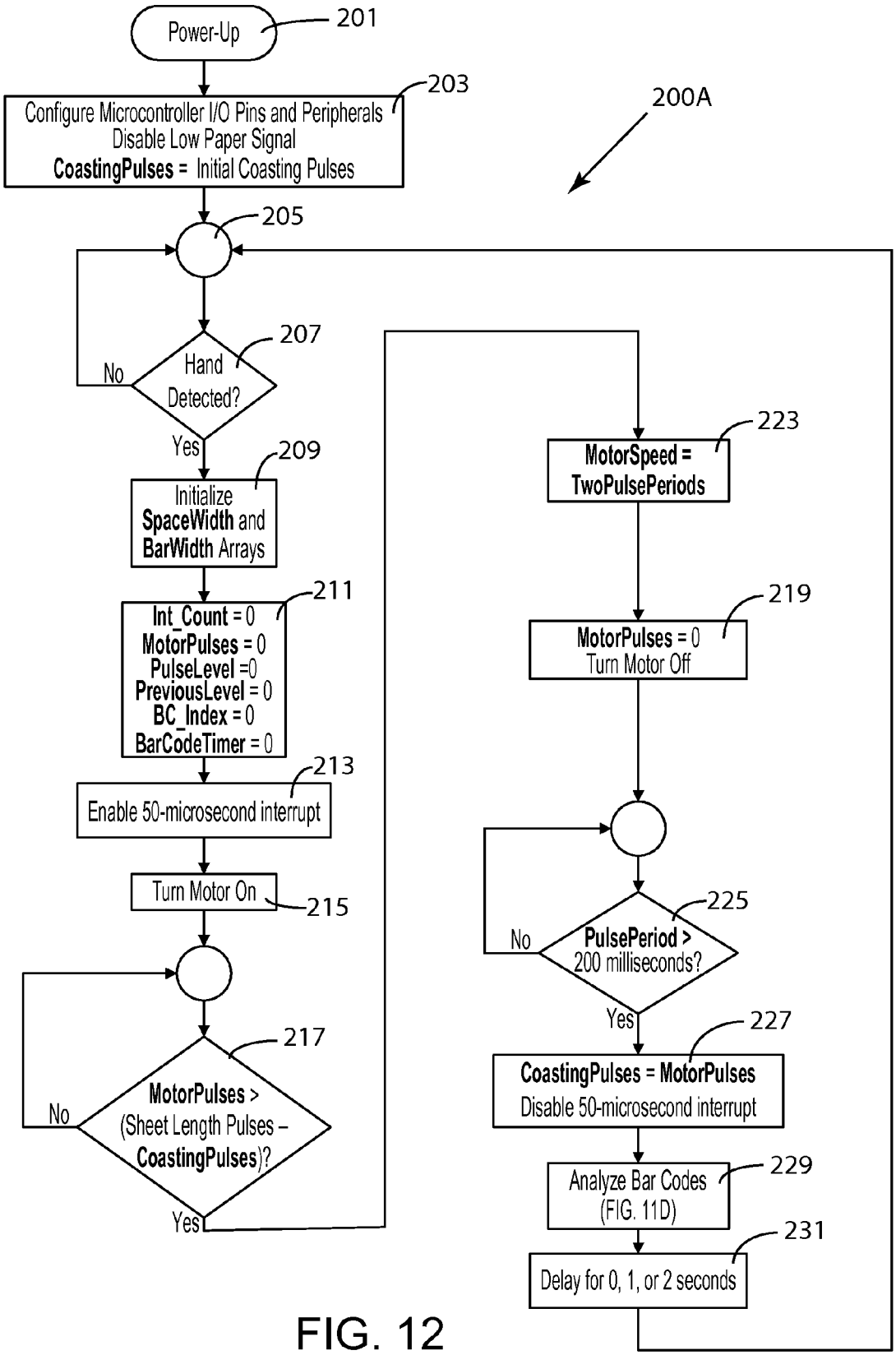
FIG. 12 is a logic flow diagram of an alternative embodiment of the general logic implemented by the controller that may be used to control the dispenser embodiment of FIGS. 1-4 and 7.

FIG. 12 illustrates an alternative embodiment of the inventive low-material sensing system which utilizes motor pulses generated while motor 21 is powered. Such pulses are labeled with reference number 159 in FIG. 10. In this alternative embodiment, the alternative main control logic 200A of FIG. 12 replaces main control logic 200 of the embodiment just described. FIG. 12 is used in conjunction with the logic of FIGS. 11B through 11D and in conjunction with bar code 75 as described in FIGS. 8 and 8A. In alternative main control logic 200A, similar logic elements are identified using the same reference numbers as in FIG. 11A.

Alternative main control logic 200A proceeds in the same manner as described with respect to main control logic 200 in FIG. 11A except that the determination of motor speed is made using the variable TwoPulsePeriods in functional element 223 based on a value of such variable measured just prior to motor 21 being deactivated in functional element 219. All other logic elements of alternative main control logic 200A operate as previously described.

The strategy described herein facilitates accurate determination of the low-material state. One factor contributing to such accuracy is that the motor 21 speed and core 59 speed determinations may be made during steady-state motor 21 operation and roll 11 rotation, thus avoiding potential inaccuracy associated with an angular displacement measurement system which may not account for supply roll 11 overspin resulting from inertia.

The present strategy is most preferably implemented by obtaining motor 21 speed and core 59 speed at different times in a dispense cycle. Motor 21 rotational speed is preferably obtained from motor 21 armature 23 rotation pulse data during the "motor coasting" portion of a dispense cycle, immediately after current to motor 21 is deactivated when the motor is at steady-state operation. During motor 21 coasting, well-defined pulses 153, 155 and 157 can be identified in the digitized motor signal as illustrated in FIG. 10. These prominent coasting pulses 153, 155, 157 are well-suited for detection to determine motor 21 speed determination and yield accurate measurements of motor 21 speed.

Supply roll 11 rotational speed is best determined from bar code data captured during the "motor on" portion of a dispense cycle when drive roller 17 pulls paper 12 through nip 15 and rotates roll 11. Such core 59 speed information represents steady-state roll 11 rotation which yields accurate core 59 speed information. The accuracy of the motor 21 speed and core 59 speed information provides for a reliable indication of the low-material state.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. Apparatus for dispensing sheet material from a roll including a low-material sensing system, the apparatus comprising:

a sensor which generates a sensor signal indicative of sheet material roll rotation;

a direct current motor having an armature, the motor producing movement of the sheet material when current is supplied to the motor;

a low-material indicator; and a controller coupled to the motor, sensor and indicator and having an analog-to-digital converter, the controller being operable to:

digitize a motor signal indicative of at least one of motor current and motor voltage;

digitize the sensor signal;

detect pulses in the digitized motor signal during motor armature rotation;

measure a time between motor signal pulses which occur after the motor is de-powered and is coasting, the time being indicative of motor rotational speed;

detect the digitized sensor signal during sheet material roll rotation and determine sheet material roll rotational speed therefrom;

compute a ratio of the rotational speeds; and activate the indicator when the ratio reaches a threshold representative of a low-material state.

2. The dispenser of claim 1 wherein the indicator is selected from the group consisting of visual indicators and audible indicators.

3. The dispenser of claim 2 wherein the visual indicator is a lamp.

4. The dispenser of claim 1 wherein the controller is further operable to:

detect contiguous motor signal pulses after the motor is de-powered and is coasting; and measure the time between the first and last of the contiguous pulses.

5. The dispenser of claim 4 wherein the contiguous pulses comprise three contiguous pulses.

6. The dispenser of claim 1 wherein the controller is further operable to ignore the first motor signal pulse after the motor is de-powered.

7. The dispenser of claim 6 wherein the controller is further operable to measure the time between the first and third pulses after the ignored pulse.

8. The dispenser of claim 1 wherein the sensor is an optical sensor responsive to reflectivity of a variable reflectivity pattern on the sheet material roll.

9. The dispenser of claim 8 wherein the optical sensor is a bar code sensor which senses a bar code on the sheet material roll.

10. The dispenser of claim 9 wherein the sheet material is wound on a core and the bar code is located on a core inner surface.

11. The dispenser of claim 10 further including:

a sheet material roll support; and the bar code sensor is on the roll support.

12. The dispenser of claim 11 wherein the bar code sensor comprises:

an optical source operable to direct optical energy toward the bar code; and an optical detector operable to receive optical energy from the bar code to generate the sensor signal.

13. The dispenser of claim 10 wherein the core inner surface includes a plurality of bar codes.

14. The dispenser of claim 13 wherein each of the plurality of bar codes is identical to the other.

15. The dispenser of claim 14 further comprising a quiet zone between each of the bar codes.

16. The dispenser of claim 15 wherein the bar code sensor generates the sensor signal during sheet material roll rotation, the sensor signal includes pulses associated with the bar codes and quiet zones and the controller is further operable to measure the time between a first pulse edge after the quiet zone and a second pulse edge thereafter, such time being indicative of sheet material roll rotational speed.

17. A method for controlling a motor-driven sheet material dispenser to provide an indication that the supply of sheet material on a roll is low, the method comprising:

powering a DC motor having an armature to produce movement of the sheet material roll;

digitizing a motor signal indicative of at least one of motor current and motor voltage;

digitizing a sensor signal indicative of sheet material roll rotation;

detecting pulses in the digitized motor signal during motor armature rotation;

measuring a time between motor signal pulses which occur after the motor is de-powered and is coasting, the time being indicative of motor rotational speed;

detecting the digitized sensor signal during sheet material roll rotation and determining sheet material roll rotational speed therefrom;

computing a ratio of the rotational speeds; and providing an indication when the ratio reaches a threshold representative of the supply of sheet material being low.

18. The method of claim 17 wherein the sheet material roll includes a bar code and the method further comprises sensing the bar code with a sensor and outputting the sensor signal corresponding to the bar code.

19. The method of claim 17 wherein providing the indication further comprises activating an indicator selected from the group consisting of visual indicators and audible indicators.

20. The method of claim 17 wherein:

detecting pulses in the digitized motor signal includes detecting contiguous motor signal pulses after the motor is de-powered and is coasting; and measuring the time between motor signal pulses includes measuring the time between the first and last of the contiguous pulses.

21. The method of claim 20 wherein detecting pulses in the digitized motor signal further includes detecting three contiguous motor signal pulses.

22. The method of claim 17 further including ignoring the first motor signal pulse after the motor is de-powered.

23. The method of claim 22 wherein measuring the time between motor signal pulses further includes measuring the time between the first and third motor signal pulses after the ignored motor signal pulse.

24. The method of claim 23 wherein the bar code is preceded by a quiet zone and the method further includes measuring the time between a first pulse edge after the quiet zone and a second pulse edge thereafter, the time being indicative of sheet material roll rotational speed.

25. The method of claim 24 wherein the sheet material roll is on a core and the bar code is on an inner surface of the core.

26. The method of claim 25 wherein the core inner surface includes a plurality of bar codes.

27. The method of claim 26 wherein each of the plurality of bar codes is identical to the other.

28. The method of claim 26 wherein the core inner surface further includes a quiet zone between each of the bar codes.

29. The method of claim 17 wherein the sheet material roll includes a bar code having elements of known width and the sensor signal includes pulses corresponding to the known widths.

30. Apparatus for dispensing sheet material from a roll including a low-material sensing system, the apparatus comprising:

a sensor which generates a sensor signal indicative of sheet material roll rotation;

a DC motor having an armature, the motor producing movement of the sheet material roll when power is supplied to the motor and having a motor signal indicative of at least one of motor current and motor voltage, the motor signal including pulses when the motor is powered and when the motor is coasting after de-powering;

a low-material indicator; and a circuit coupled to the sensor, motor and indicator which supplies to a processing device a digitized motor signal and a digitized sensor signal;

the processing device being operable to:

detect pulses in the digitized motor signal during motor armature rotation;

measure a time between motor signal pulses which occur after the motor is de-powered and is coasting, the time being indicative of motor speed;

detect pulses in the digitized sensor signal during sheet material roll rotation and determine sheet material roll rotational speed therefrom;

compute a ratio of the rotational speeds; and activate the indicator when the ratio reaches a threshold representative of a low-material state.

* * * * *